US012577715B2

(12) United States Patent
Hinduja et al.

(10) Patent No.: US 12,577,715 B2
(45) Date of Patent: Mar. 17, 2026

(54) SYSTEM FOR AUTOMATED MANUFACTURING OF GARMENTS

(71) Applicants: Munish Jagadish Hinduja, Bangalore (IN); Narasingamoorthy Ganesan, Madurai (IN)

(72) Inventors: Munish Jagadish Hinduja, Bangalore (IN); Narasingamoorthy Ganesan, Madurai (IN)

( * ) Notice: Subject to any disclaimer, the term of this patent is extended or adjusted under 35 U.S.C. 154(b) by 57 days.

(21) Appl. No.: 18/778,982

(22) Filed: Jul. 21, 2024

(65) Prior Publication Data

US 2025/0027243 A1 Jan. 23, 2025

(30) Foreign Application Priority Data

Jul. 20, 2023 (IN) ..... 202341048775

(51) Int. Cl.

| | |
|---|---|
| ***D05B 25/00*** | (2006.01) |
| ***D05B 33/02*** | (2006.01) |
| ***D05B 35/12*** | (2006.01) |
| ***D05B 39/00*** | (2006.01) |

(52) U.S. Cl.

CPC ..... *D05B 25/00* (2013.01); *D05B 33/02* (2013.01); *D05B 35/12* (2013.01); *D05B 39/00* (2013.01)

(58) Field of Classification Search

CPC ..... D05B 25/00; D05B 27/00; D05B 33/02; D05B 35/02; D05B 39/00; D05B 41/00

See application file for complete search history.

(56) References Cited

U.S. PATENT DOCUMENTS

| | | | | |
|---|---|---|---|---|
| 3,670,675 | A * | 6/1972 | Rovin | D05B 33/02 112/475.09 |
| 4,608,936 | A * | 9/1986 | Ball | B26D 7/0625 112/470.07 |
| 4,635,574 | A * | 1/1987 | Fujita | D05B 25/00 112/155 |
| 5,003,897 | A * | 4/1991 | Yokoe | G05B 19/41825 112/155 |
| 5,178,381 | A * | 1/1993 | Nash | D05B 25/00 271/264 |
| 9,681,709 | B2 * | 6/2017 | Manz | A43B 23/0235 |
| 11,771,159 | B2 * | 10/2023 | Park | A41H 3/007 33/17 R |
| 2018/0024518 | A1 * | 1/2018 | Jin | G06Q 10/0631 112/217.2 |
| 2020/0397081 | A1 * | 12/2020 | Park | G06Q 10/06316 |
| 2022/0361612 | A1 * | 11/2022 | Park | G06Q 50/04 |
| 2024/0175179 | A1 * | 5/2024 | Fujie | D05B 35/08 |

* cited by examiner

*Primary Examiner* — Danny Worrell

(74) *Attorney, Agent, or Firm* — Patshegen IP; Moshe Pinchas

(57) ABSTRACT

The disclosure herein generally relates to manufacturing of garments and more particularly to a system for automated manufacturing of garments. The system is configured to automatically perform operations on fabric sections to manufacture finished garments without manual intervention and at low costs. The system monitors the operations performed on the fabric sections and automatically adjusts the alignment/handling of the fabric sections to ensure quality finished garments. The system eliminates human error and enhances the sewing quality and increases production of garments.

18 Claims, 26 Drawing Sheets

SYSTEM FOR AUTOMATED MANUFACTURING OF GARMENTS

CROSS REFERENCE TO RELATED APPLICATION

This Application is based on and derives the benefit of Indian Application 202341048775 filed on 20 Jul. 2023, the contents of which are incorporated herein by reference.

TECHNICAL FIELD

The embodiments herein generally relate to manufacturing of garments and more particularly to a system for automated manufacturing of garments.

BACKGROUND

Generally, sewing machines are used for sewing multiple fabric sections to form garments. Despite technological advances and introduction of automation in many types of manufacturing sectors, garment manufacturing remains very labor intensive and therefore cost intensive. Ready-to-wear garment is typically manufactured in factories which produce large numbers of garments at a time. The process of producing large quantities of ready-to-wear garments remains inefficient relative to other industrial manufacturing sectors. Garment manufacturing includes multiple steps including sizing, folding, fitting, cutting, sewing, and material handling. The type of tasks needed dictates the level of skilled labor that is required to perform the work. The unique and varied properties of fabric such as weight, thickness, strength, stretchiness and draping as well as the complicated nature of tasks required in garment manufacturing complicates material handling and automated garment manufacturing. The garment manufacturing process starts with cutting one or more layers of fabric based on patterns and dimensions matching the desired garment. Then, the cut fabric patterns are transferred from workstation to workstation, where at each workstation, one, two or more pieces of fabrics are manually folded, overlapped along the seams and fed into a sewing or serger (overlocker) machine. Given the variety of fabrics, threads, seam types and stitch types found in a finished garment, a larger number of workstations with specialized tools and skilled operators is required for assembling a garment. This means the fabrics or unfinished garments spend a lot of time in transit between workstations. Unlike most many manufacturing industries benefiting from recent innovations and advances in material handling, in most small and large garment manufacturing factories, most of the material handling and garment manufacturing operations are conducted in a manual or semi-manual manner.

Currently, despite advances in technology, machines still struggle with performing certain tasks that are easily handled by a trained worker with average hand-eye coordination skills. This is one reason garment manufacturing industry is in a constant search of cheaper human labor rather than investing in advanced automated manufacturing systems. So, in many cases, the difference between small and large garment manufacturing operations is the number of workers it engages to increase production, a factory may add additional production lines in parallel. However, in general, increasing production in this manner does little to improve efficiency. Even in large factories, most work is performed in piecemeal fashion, with limited coordination between various stations/steps, and movement of material between each station requires a great deal of manual product handling. Therefore, the entire garment manufacturing process remains labor intensive and inefficient, where work is performed in a discontinuous batch processing fashion, causing garment manufacturers to move from country to country in a continuous search for lower labor costs for manual and semi-skilled labor. Most of the innovations in the garment manufacturing industry have been directed to improving individual tools. For example, new features may be added to a sewing machine to convert it from manual to a semi-automatic or automatic tool. However, all material handling needs would still require a manual manipulation, including loading and unloading piecemcal work in and off the tool.

Another constraint in today's garment manufacturing is the inability to efficiently produce in small batches or mass produce customized garments tailored to every consumer's body shape and measurements. Manufactures rely on economies of scale and require minimum order quantity which may be out of reach for small brands and designers. Given the heavily manual and piecemeal processes in the current manufacturing operations, small batches or mass customized production that requires constantly shifting product designs, material selections and sizing and sewing techniques result in production difficulties and resulting manufacturing errors and resulting lower yields.

In addition to mass production in a factory, garment can also be prepared by hand by custom tailoring, whether at home or commercially by a tailor or seamstress. Custom tailoring generally involves measuring a customer, having a customer choose style, fabric, and fit preferences, sewing the garment, and potentially adjusting the garment's fit during the course of one or more fittings. The resultant garment has a fit and style which is personalized to the customer's preferences, but it is typically costly due to the large amount of manual labor involved preparing the garment and the amount of time required on the part of the customer. Consequently, custom tailoring does not constitute a large segment of the garment manufacturing industry.

Therefore, there exists a need for a system for automated manufacturing of garments, which obviates the aforementioned drawbacks.

OBJECTS

The principal object of embodiments herein is to provide a system (garment manufacturing system) for automated manufacturing of garments.

Another object of embodiments herein is to automatically perform operations on fabric sections to manufacture finished garments without manual intervention and at low costs.

Another object of embodiments herein is to provide the monitor the operations performed on the fabric sections and adjusts the alignment/handling of the fabric sections to ensure quality finished garments.

Another object of embodiments herein is to provide the automatic garment manufacturing system which eliminate human error and enhances the sewing quality and increases production of garments.

These and other objects of embodiments herein will be better appreciated and understood when considered in conjunction with following description and accompanying drawings. It should be understood, however, that the following descriptions, while indicating embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF DRAWINGS

The embodiments are illustrated in the accompanying drawings, throughout which like reference letters indicate corresponding parts in various figures. The embodiments herein will be better understood from the following description with reference to the following illustratory drawings. Embodiments herein are illustrated by way of examples in the accompanying drawings, and in which.

DETAILED DESCRIPTION

Figure 1:
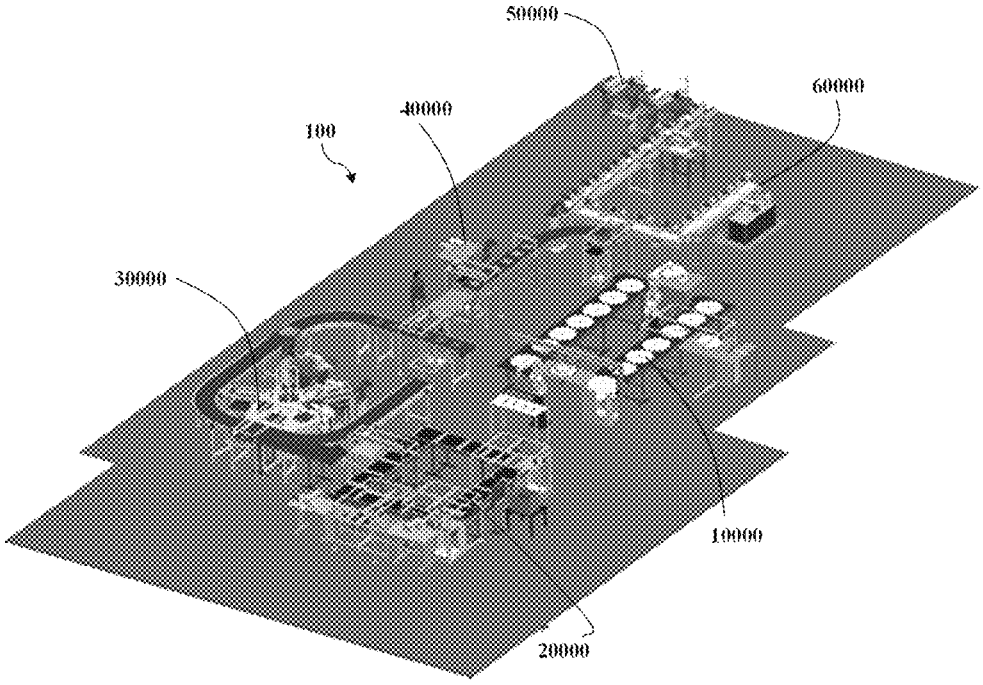
FIG. 1 depicts a layout of a system (automated garment manufacturing system) for automated manufacturing of garments, according to embodiments as disclosed herein.
Figure 2:
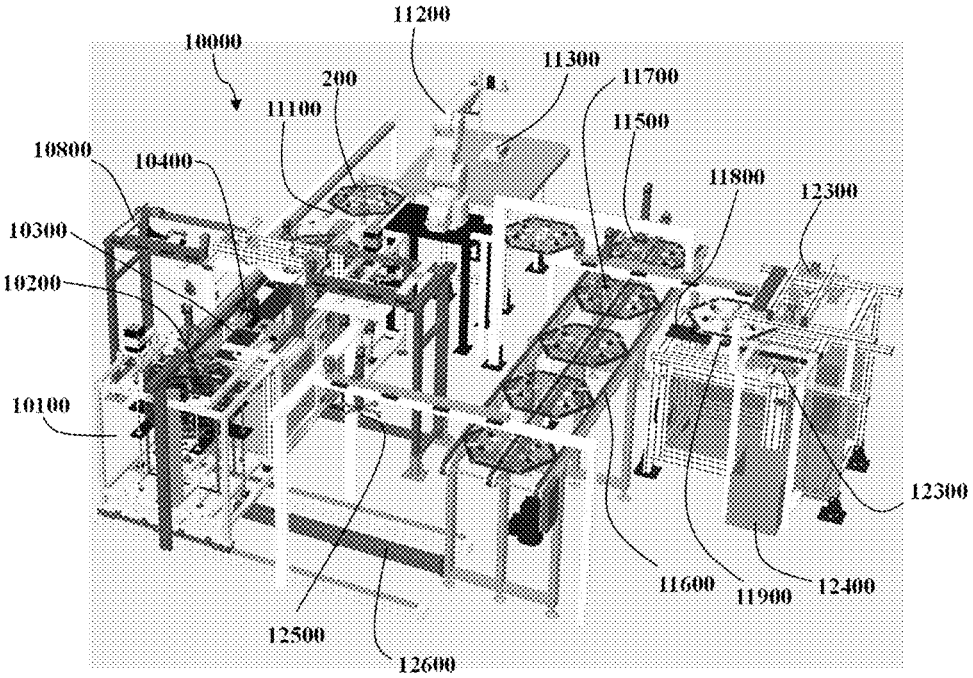
FIG. 2 depicts a perspective view of a firsts sewing system of the automated garment manufacturing system, according to embodiments as disclosed herein.
Figure 3:
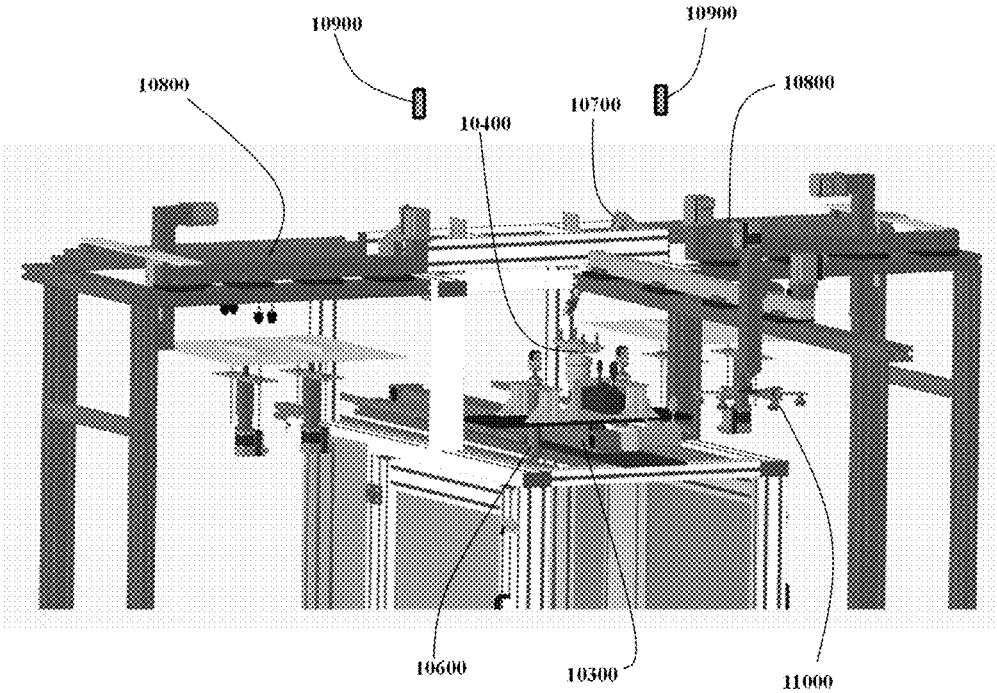
FIG. 3 illustrates a pair of first fabric handling systems which loads first fabric sections onto corresponding faces of a first pallet of the first sewing system, according to embodiments as disclosed herein.
Figure 4:
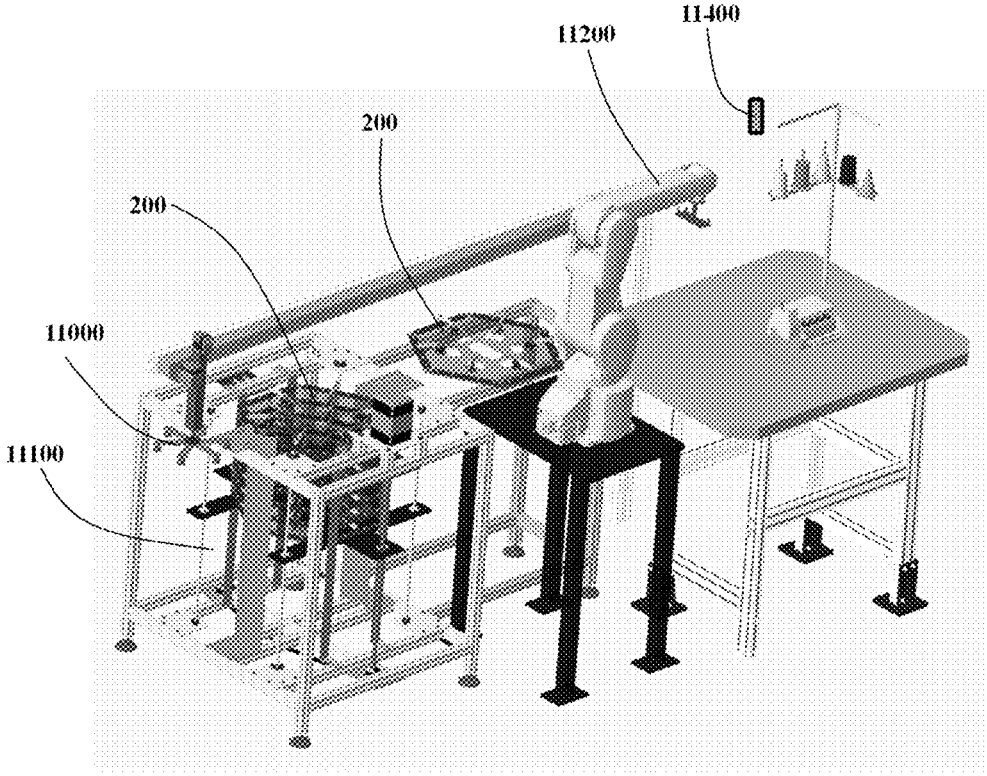
FIG. 4 illustrates a robotic manipulator and a sewing machine of the first sewing system, according to embodiments as disclosed herein.
Figure 5:
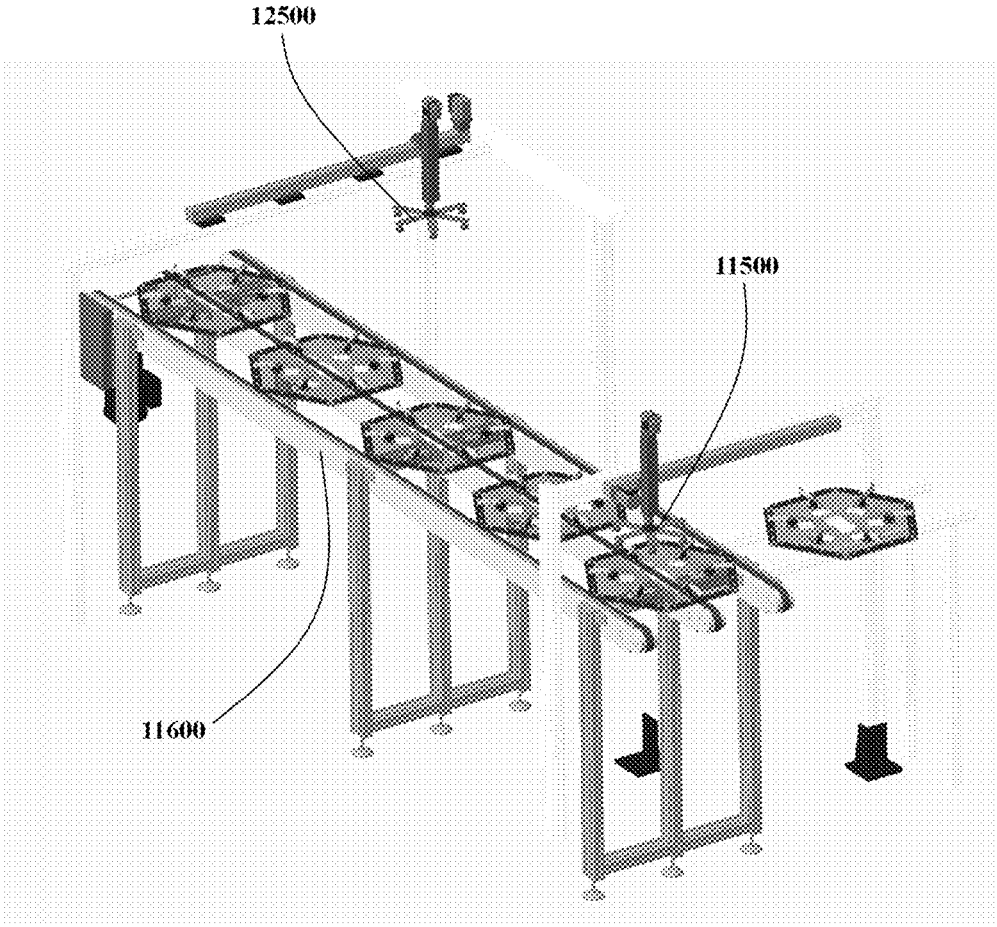
FIG. 5 illustrates a conveyor for moving the first pallets, according to embodiments as disclosed herein.
Figure 6:
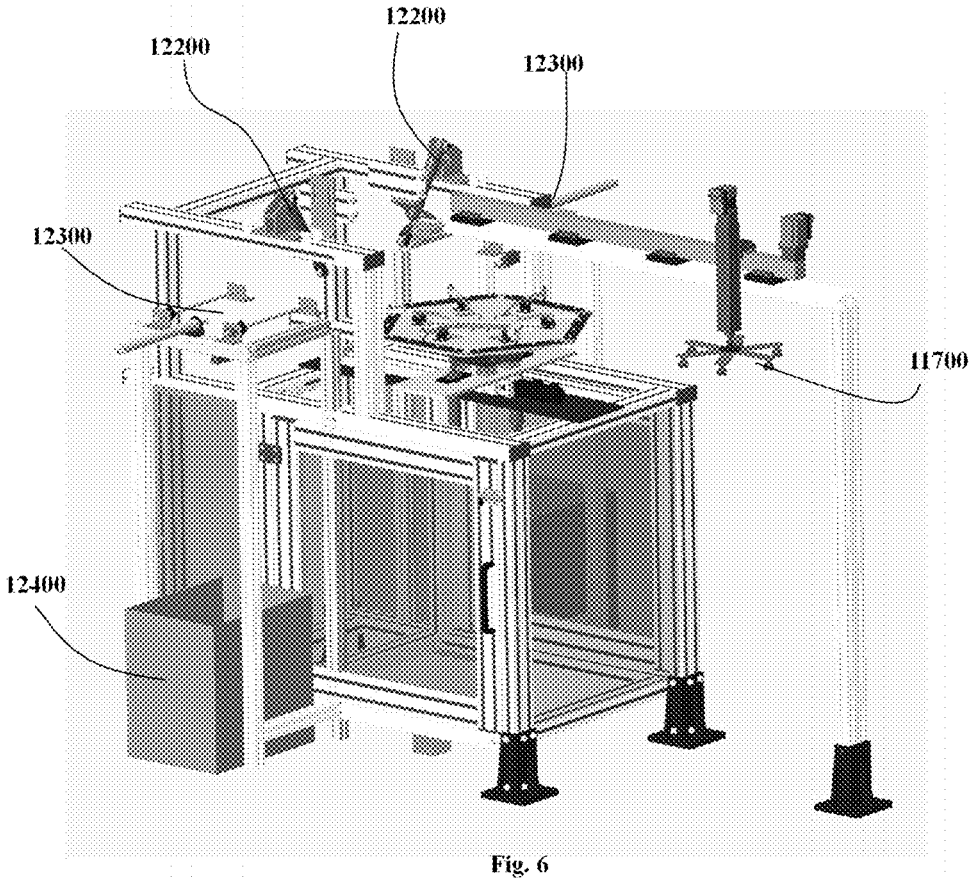
FIG. 6 illustrates unloading of sewn first fabric sections from the first pallets, according to embodiments as disclosed herein.
Figure 7:
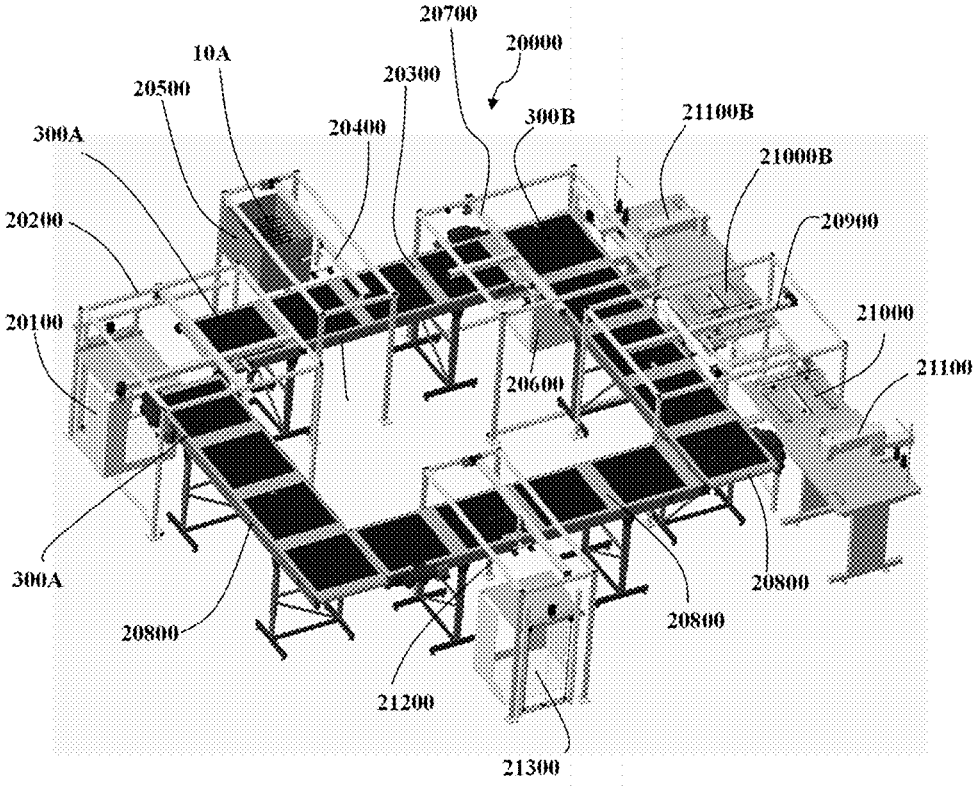
FIG. 7 depicts a perspective view of a second sewing system, according to embodiments as disclosed herein.
Figure 8:
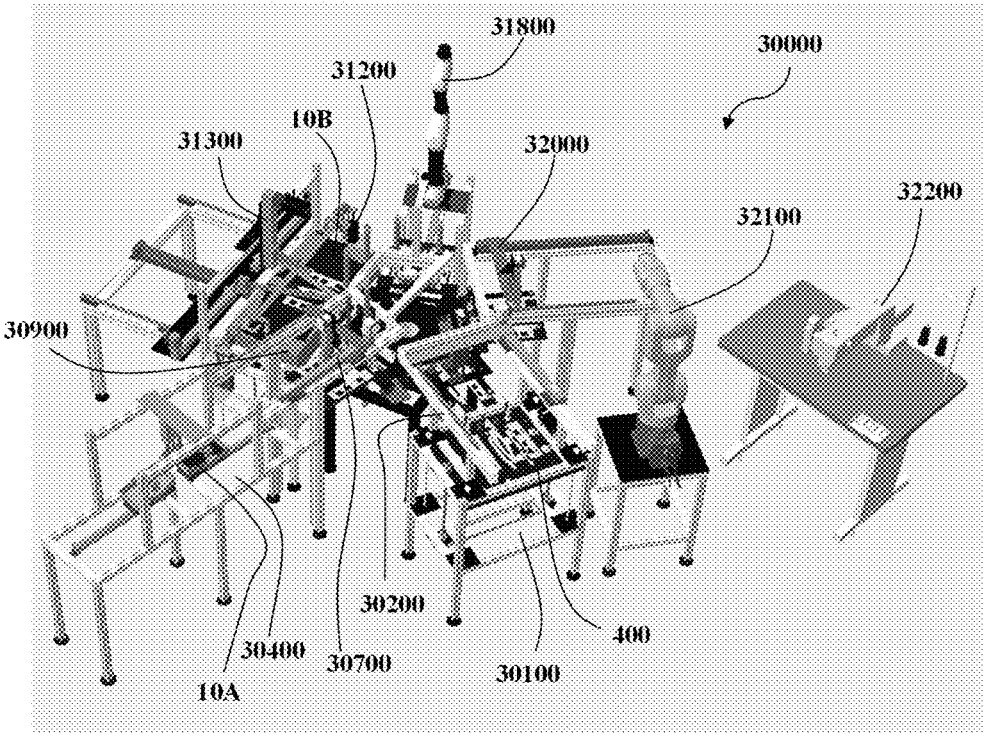
FIG. 8 depicts a perspective view of a third sewing system, according to embodiments as disclosed herein.
Figure 9:
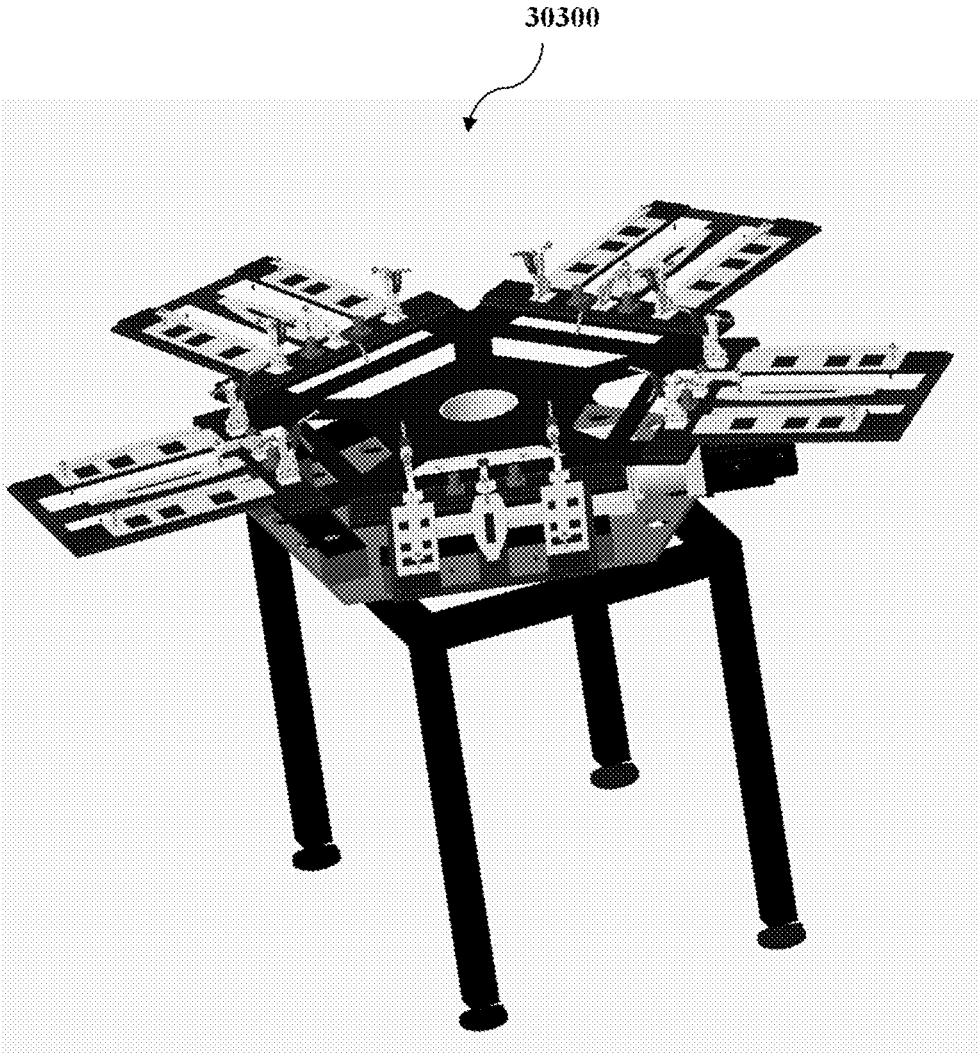
FIG. 9 depicts a perspective view of a rotary indexer of the third sewing system, according to embodiments as disclosed herein.
Figure 10:
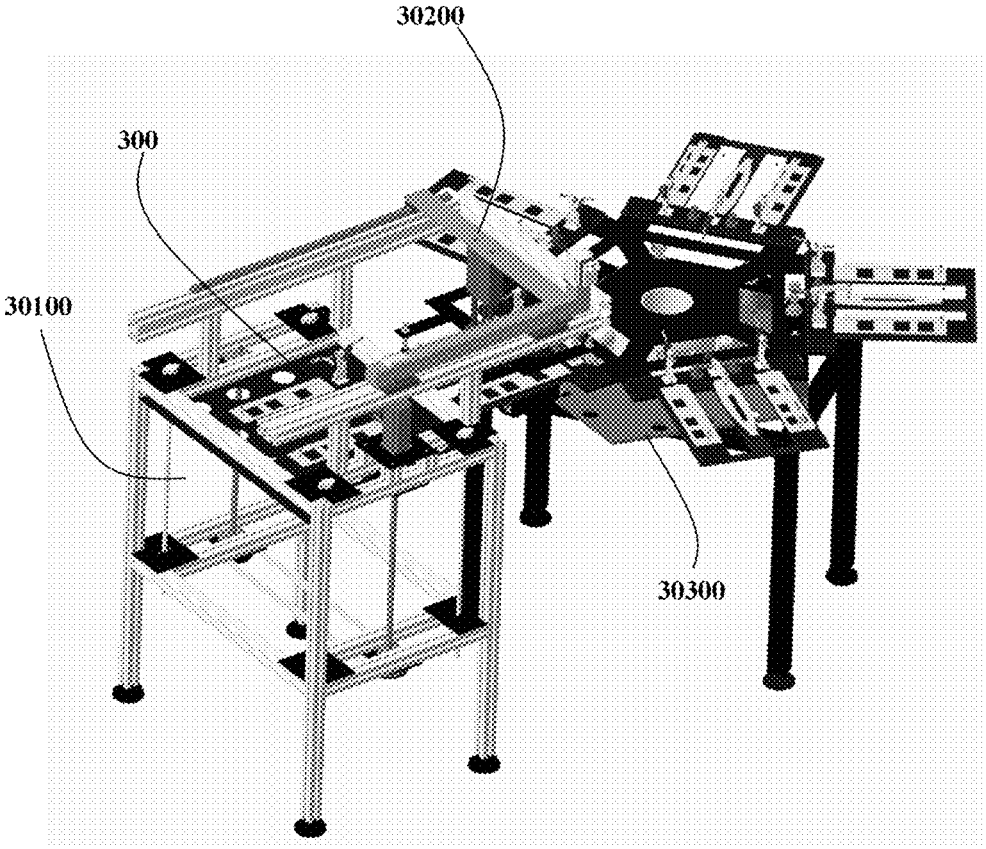
FIG. 10 illustrates grasping of a third pallet from a pallet storing apparatus and loading of the third pallet onto an indexing platform of the rotary indexer, according to embodiments as disclosed herein.
Figure 11:
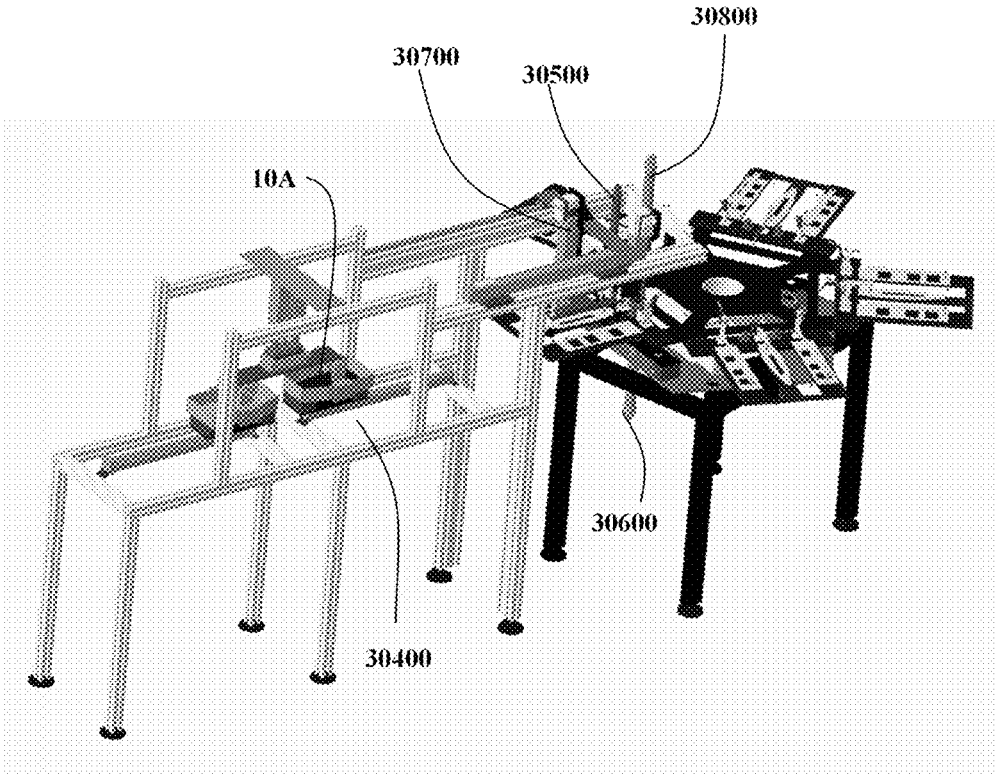
FIG. 11 illustrates grasping of the sewn first fabric section from a first fabric storing system and loading of the first fabric section onto the third pallet, according to embodiments as disclosed herein.
Figure 12:
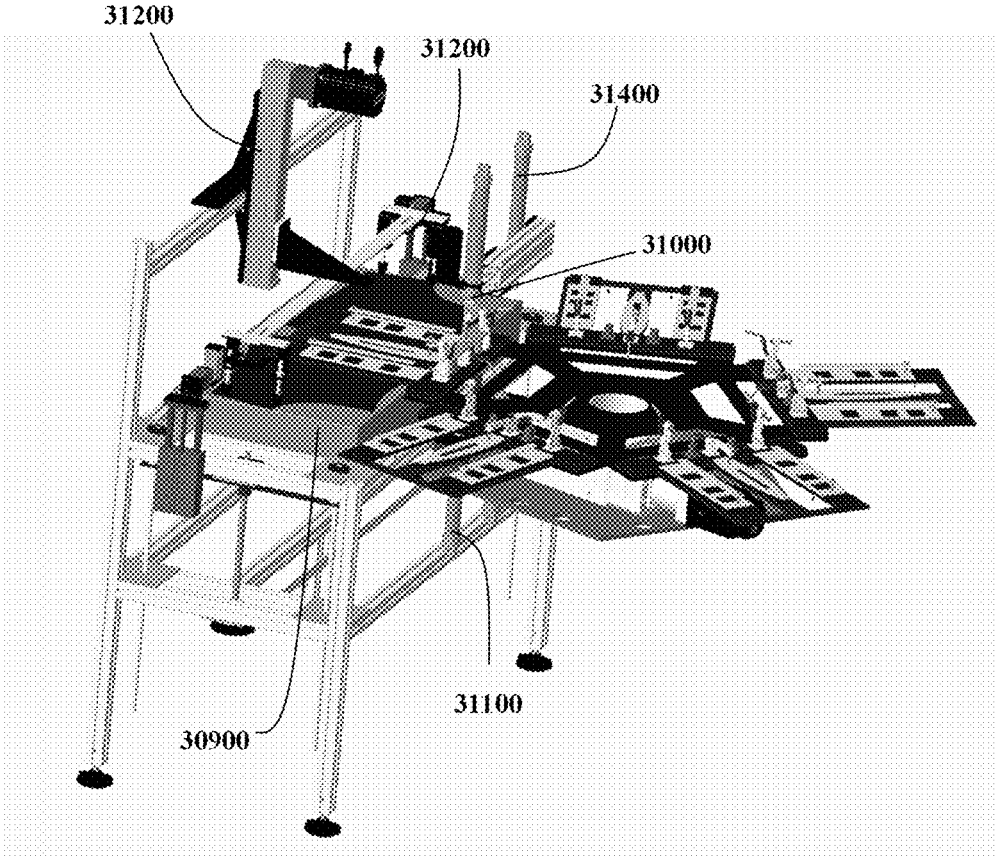
FIG. 12 illustrates lifting of a second fabric section prior to folding corresponding side portion of the second fabric section with respect to corresponding side ends of the first fabric section, according to embodiments as disclosed herein.
Figure 13:
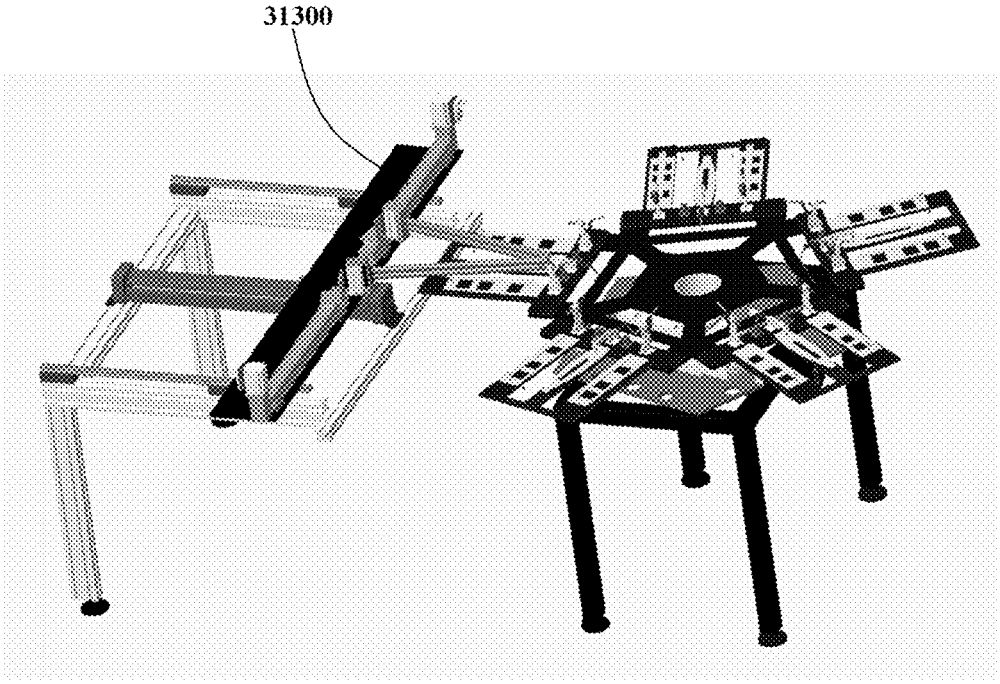
FIG. 13 illustrates a fabric folding system of the third sewing system, according to embodiments as disclosed herein.
Figure 14:
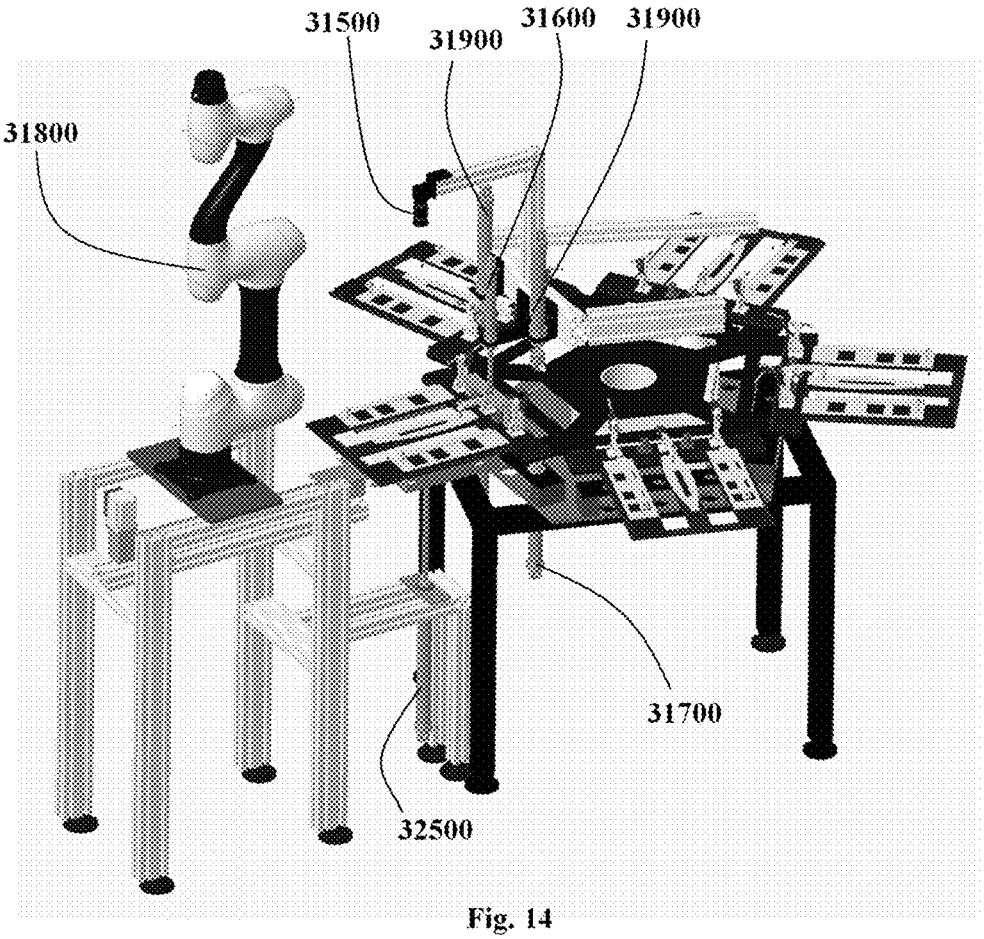
FIG. 14 illustrates a first robotic manipulator for adjusting the second fabric section to align the side portions of the second fabric section with corresponding side edges of the first fabric section, according to embodiments as disclosed herein.
Figure 15:
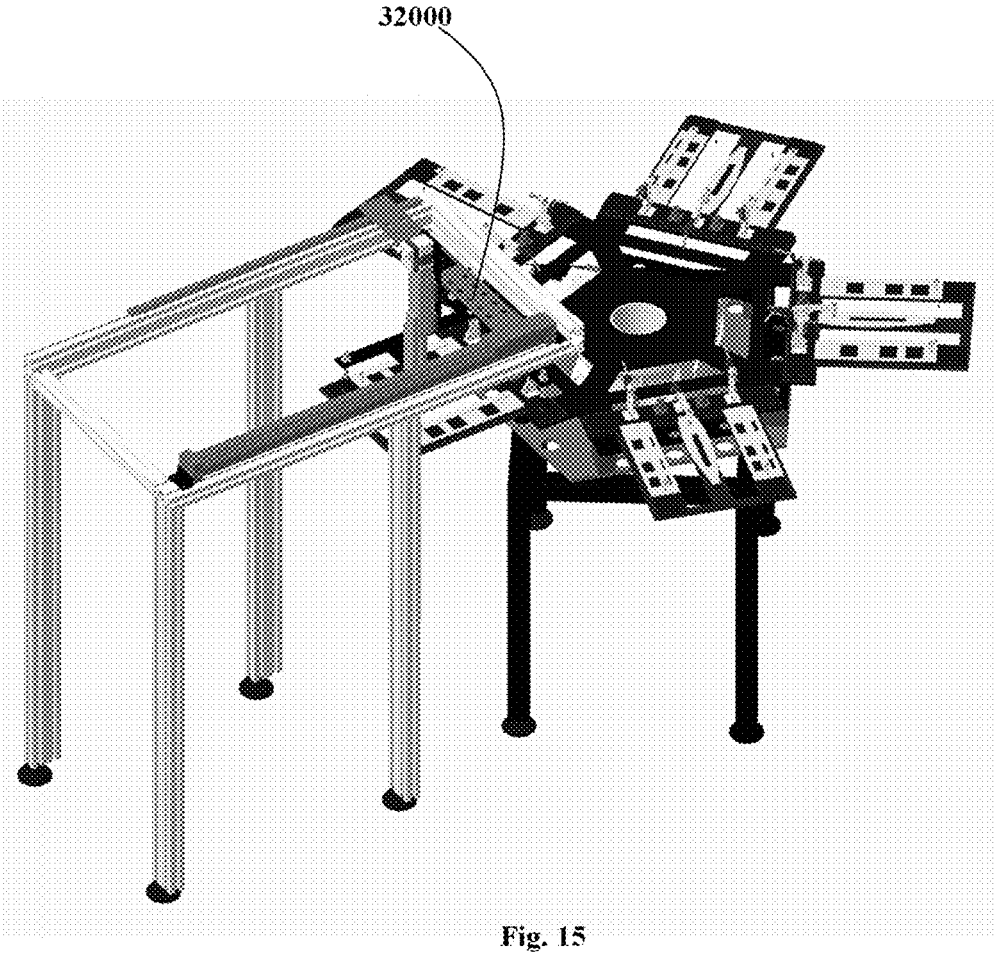
FIG. 15 illustrates grasping of the pallet from the indexing platform of the rotary indexer for moving the third pallet near to a second robotic manipulator, according to embodiments as disclosed herein.
Figure 16:
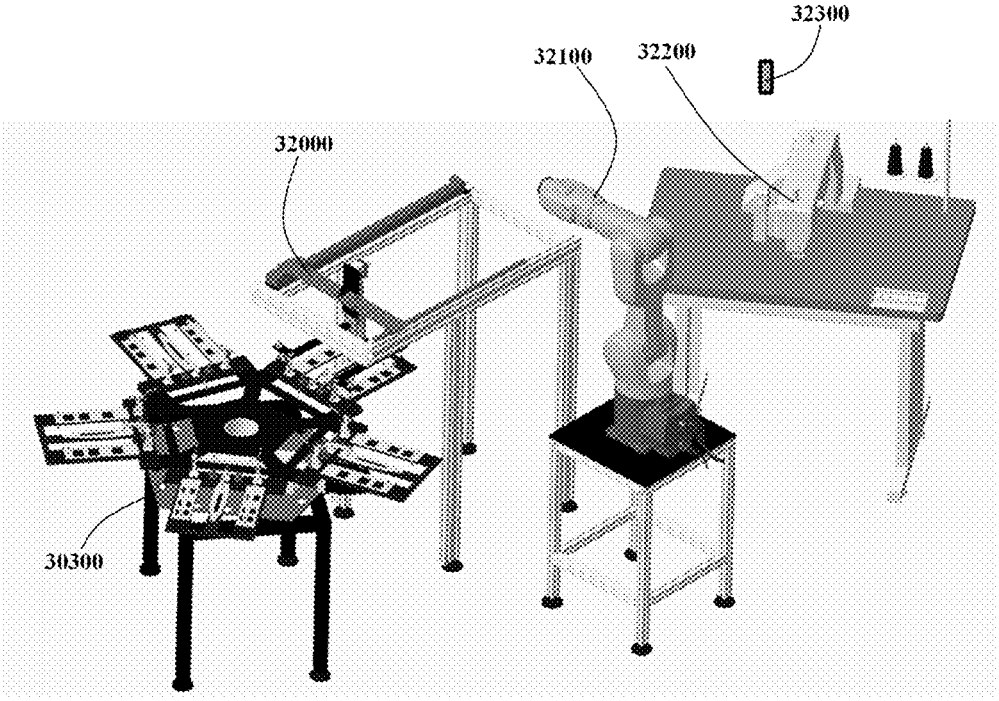
FIG. 16 illustrates the second robotic manipulator grasping the third pallet and feeding the third pallet along with the first and second fabric sections to a sewing machine for performing a third sewing operation on the first and second fabric sections, according to embodiments as disclosed herein.
Figure 17:
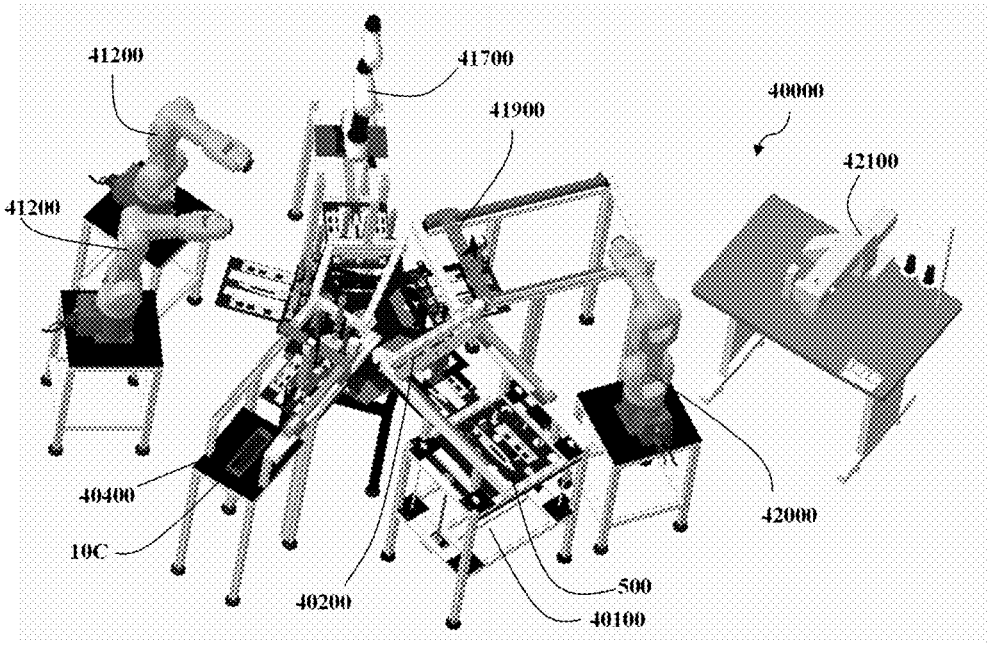
FIG. 17 illustrates a perspective view of a fourth sewing system, according to embodiments as disclosed herein.
Figure 18:
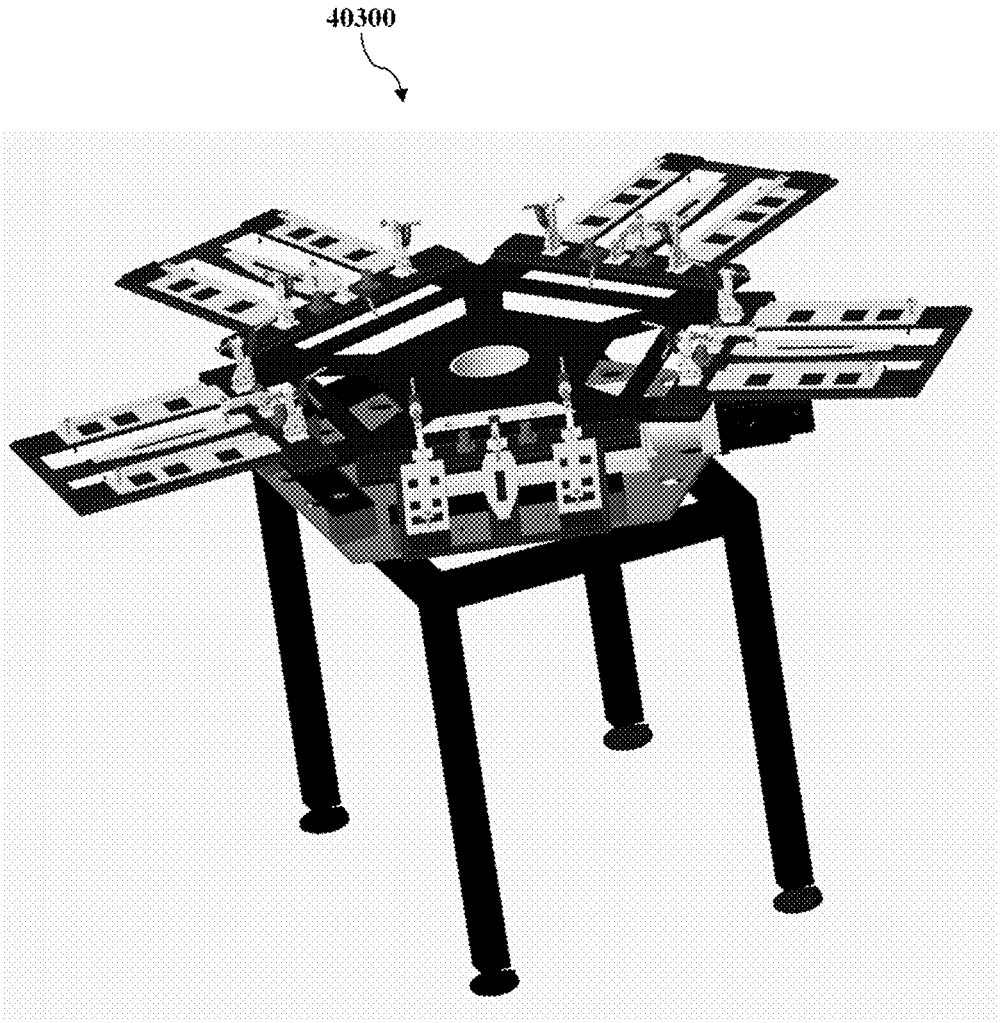
FIG. 18 illustrates a perspective view of the rotary indexer of the fourth sewing system, according to embodiments as disclosed herein.
Figure 19:
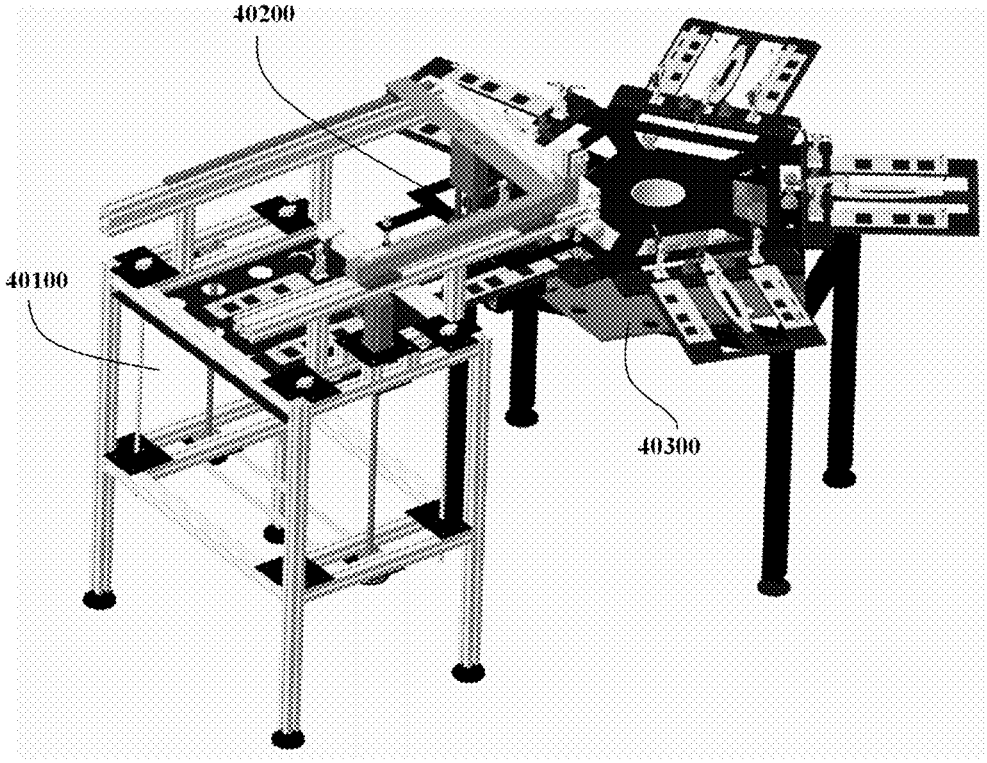
FIG. 19 illustrates a first pallet handling system which grasps a fourth pallet from a pallet storing apparatus and loads the fourth pallet onto an indexing platform of the rotary indexer, according to embodiments as disclosed herein.
Figure 20:
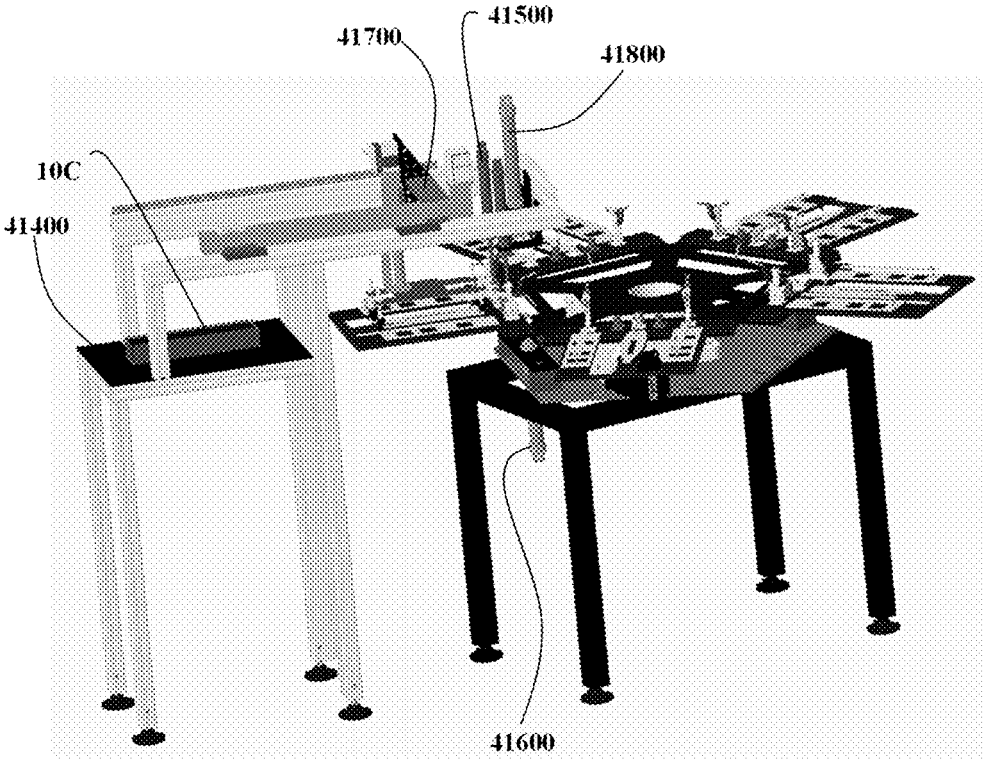
FIG. 20 illustrates a first fabric handling system which grasps a third fabric section from a fabric storing system and loads the third fabric section onto the fourth pallet, according to embodiments as disclosed herein.
Figure 21:
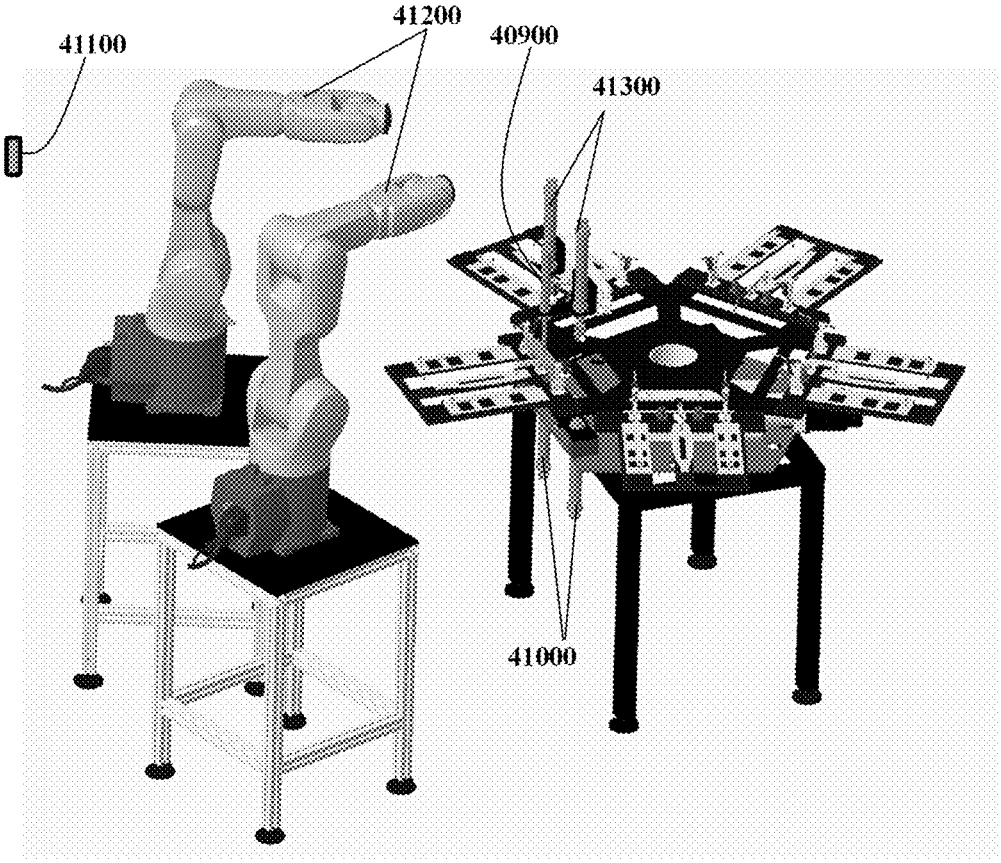
FIG. 21 illustrates a pair of first robotic manipulators for loading the sewn first and second fabric sections onto the fourth pallet with respect to the third fabric section, according to embodiments as disclosed herein.
Figure 22:
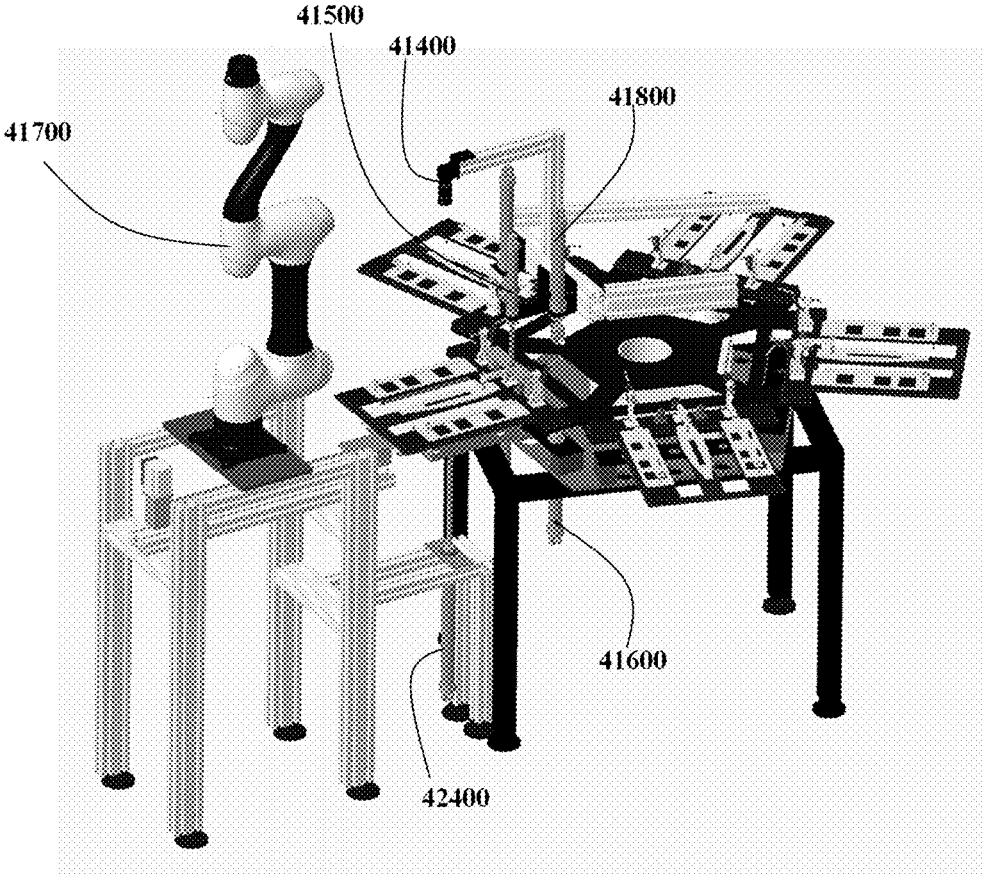
FIG. 22 illustrates a second robotic manipulator for adjusting the sewn first and second fabric sections onto the fourth pallet with respect to the third fabric section, according to embodiments as disclosed herein.
Figure 23:
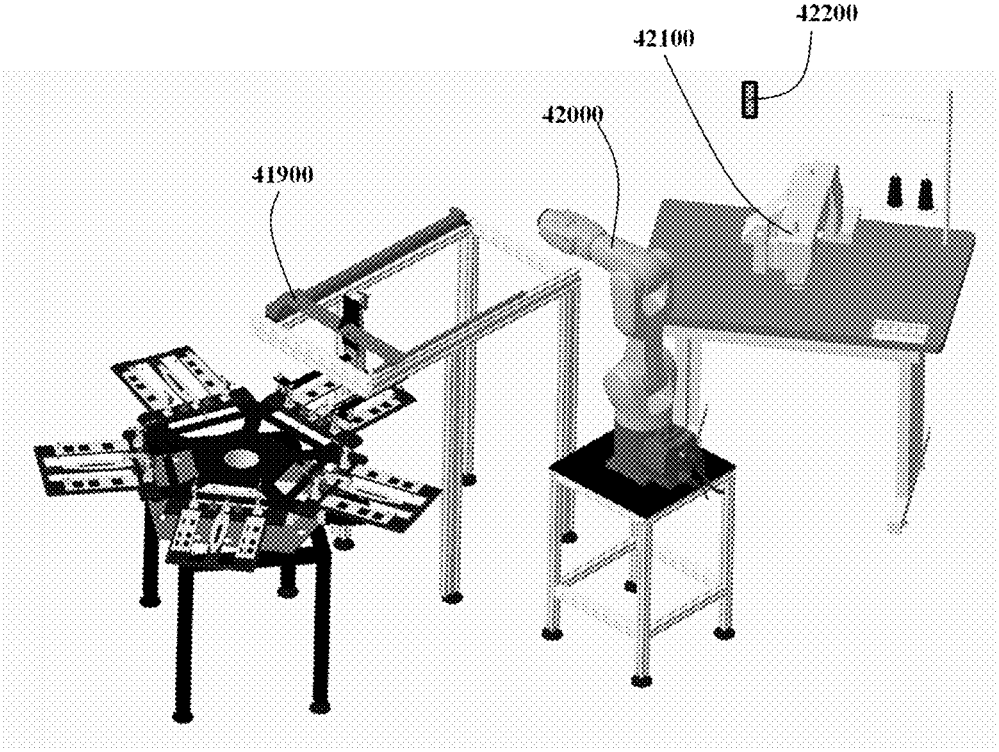
FIG. 23 illustrates a third robotic manipulator for grasping and feeding the fourth pallet along with the first, second and third fabric sections to a sewing machine for performing a fourth sewing operation on the fabric sections, according to embodiments as disclosed herein.
Figure 24:
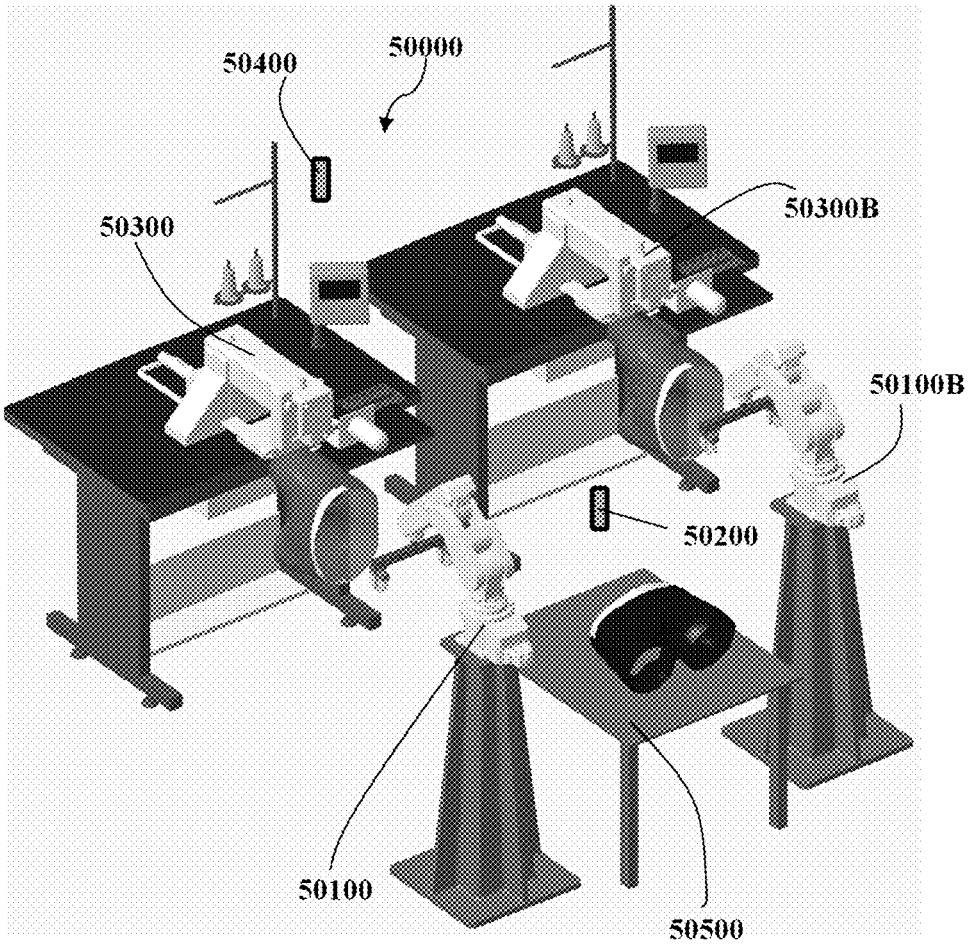
FIG. 24 depicts a perspective view of a fifth sewing system, according to embodiments as disclosed herein.
Figure 25:
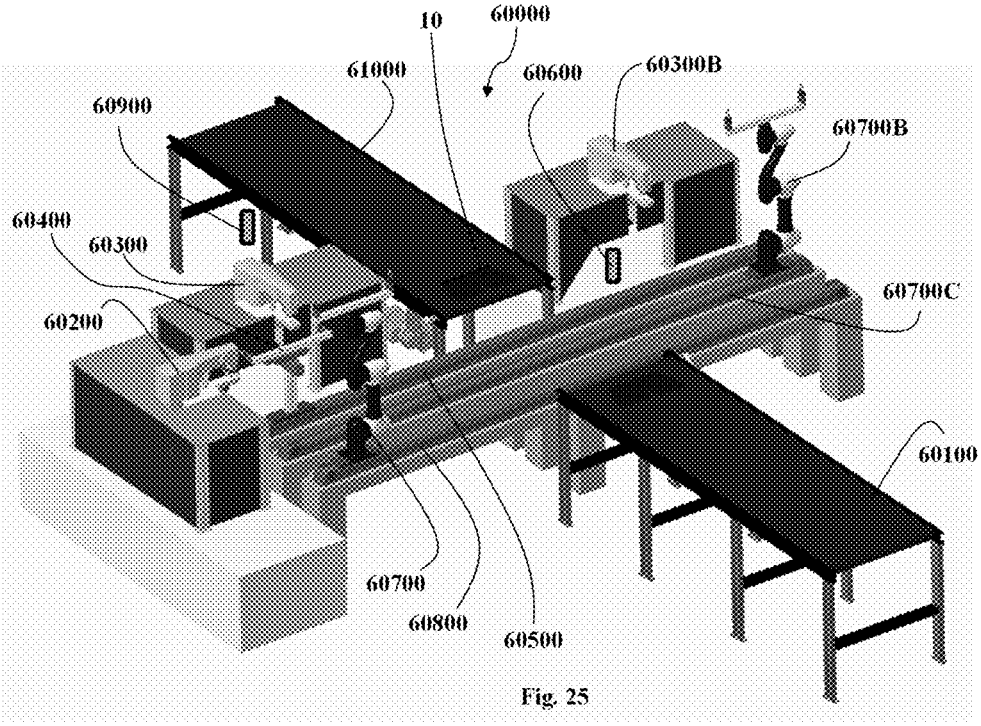
FIG. 25 depicts a perspective view of a sixth sewing system, according to embodiments as disclosed herein.
Figure 26:
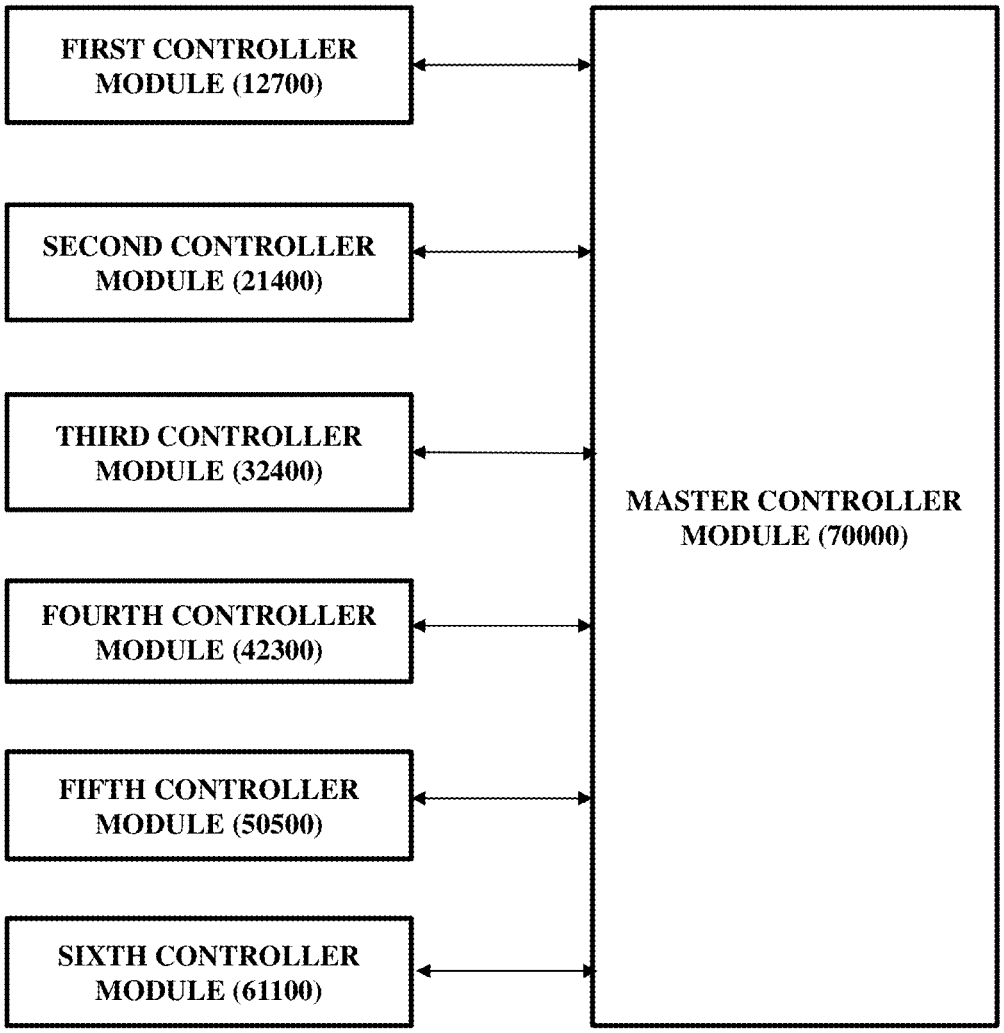
FIG. 26 illustrates a master controller module in communication with controller modules of sewing systems of the automated garment manufacturing system, according to embodiments as disclosed herein.

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

For the purposes of interpreting this specification, the definitions (as defined herein) will apply and whenever appropriate the terms used in singular will also include the plural and vice versa. It is to be understood that the terminology used herein is for the purposes of describing particular embodiments only and is not intended to be limiting. The terms "comprising", "having" and "including" are to be construed as open-ended terms unless otherwise noted.

It should be noted that elements in the drawings are illustrated for the purposes of this description and ease of understanding and may not have necessarily been drawn to scale. For example, the flowcharts/sequence diagrams illustrate the method in terms of the steps required for understanding of aspects of the embodiments as disclosed herein. Furthermore, in terms of the construction of the device, one or more components of the device may have been represented in the drawings by conventional symbols, and the drawings may show only those specific details that are pertinent to understanding the present embodiments so as not to obscure the drawings with details that will be readily apparent to those of ordinary skill in the art having the benefit of the description herein. Furthermore, in terms of the system, one or more components/modules which comprise the system may have been represented in the drawings by conventional symbols, and the drawings may show only those specific details that are pertinent to understanding the present embodiments so as not to obscure the drawings with details that will be readily apparent to those of ordinary skill in the art having the benefit of the description herein.

The accompanying drawings are used to help easily understand various technical features and it should be understood that the embodiments presented herein are not limited by the accompanying drawings. As such, the present disclosure should be construed to extend to any modifications, equivalents, and substitutes in addition to those which are particularly set out in the accompanying drawings and the corresponding description. Usage of words such as first, second, third etc., to describe components/elements/steps is for the purposes of this description and should not be construed as sequential ordering/placement/occurrence unless specified otherwise.

The embodiments herein achieve a system (automated garment manufacturing system) for automated manufacturing of garments. Further, embodiments herein achieve the automated garment manufacturing system which automatically perform operations on fabric sections to manufacture finished garments without manual intervention and at low costs. Referring now to the drawings FIGS. 1 through 26, where similar reference characters denote corresponding features consistently throughout the figures, there are shown embodiments.

FIG. 1 depicts a layout of a system (100) (automated garment manufacturing system) for automated manufacturing of garments (10), according to embodiments as disclosed herein. In an embodiment, the system (100) (automatic garment manufacturing system) includes a first sewing system (10000), a second sewing system (20000), a third sewing system (30000), a fourth sewing system (40000), a fifth sewing system (50000) and a sixth sewing system (60000) and a master controller module (70000). For the purpose of this description and ease of understanding, the system (100) is explained herein with below reference to automated manufacturing of garments such as but not limited to a men's underwear. However, it is also within the scope of the invention to use/practice the elements or mechanisms or apparatus of the system (100) with or without modifications for automated manufacturing of any other type of underwear or shirts or pants or T-shirts or trousers or inner wear or any other men's wear or any other women's wear or any other apparels without otherwise deterring the intended function of the system (100) as can be deduced from the description and corresponding drawings.

First Sewing System (10000)

The first sewing system (10000) is configured to facilitate a first sewing operation in which sewing is performed along a central portion first fabric sections (10A) along a lengthwise direction of the first fabric sections (10A). For the purpose of this description and case of understanding, the first fabric sections (10A) is considered to be a central pouch (central section) of the garment (underwear). It is also within the scope of the invention to consider the first sewing operation as any other type of sewing operation in accordance with the fabric type, product type and style of garment to be manufactured by the system (100). In an embodiment, the first sewing system (10000) includes a first pallet storing apparatus (10100), a first pallet handling system (10200), a first linear actuating system (10300), a first rotary indexer (10400), a first pallet holding system (10500), a pair of first pallet clamp unlocking systems (10600), a pair of first pallet clamp locking systems (10700), a plurality of first fabric handling systems (10800), a first vision system (10900), a second pallet handling system (11000), a second pallet storing apparatus (11100), a robotic manipulator (11200), a sewing machine (11300), a second vision system (11400), a third pallet handling system (11500), a conveyor (11600), a fourth pallet handling system (11700), a second linear actuating system (11800), a second rotary indexer (11900), a second pallet holding system (12000), a pair of second pallet clamp unlocking systems (12100), a pair of second pallet clamp locking systems (12200), a pair of second fabric handling systems (12300), a plurality of storage bins (12400), a fifth pallet handling system (12500), a third linear actuating system (12600) and a first controller module (12700).

The first pallet storing apparatus (10100) is adapted to store a plurality of first pallets (200) therein. For the purpose of this description and case of understanding, the first pallet storing apparatus (10100) is considered to be a pallet stacker apparatus. Each first pallet (200) is a hexagonal shaped pallet having six faces. It is also within the scope of the invention to provide the first pallet (200) in square shape or any other polygonal shape or any other shape based on requirements and/or the configuration of the system (100). The first pallet handling system (10200) is configured to pick-up/grasp the first pallet (200) from the first pallet storing apparatus (10100) and load the first pallet (200) onto a first indexing platform of the first rotary indexer (10400) which is mounted onto the first linear actuating system (10300). For the purpose of this description and ease of understanding, the first pallet handling system (10200) includes a first pallet handling mechanism (vacuum cup mechanism) configured for grasping and handling the first pallet (200), and a first axis linear actuator and a second axis linear actuator configured for movement of the first pallet handling mechanism (vacuum cup mechanism) between the first pallet storing apparatus (10100) and the first indexing platform of the first rotary indexer (10400).

The first linear actuating system (10300) is configured to move the first rotary indexer (10400) along with the first pallet (200) to a fabric loading zone which is in vicinity of the first fabric handling systems (10800). For the purpose of this description and case of understanding, the first linear actuating system (10300) is a single axis linear actuating system. The first pallet holding system (10500) is configured to hold the first pallet (200) when the first pallet (200) enters the fabric loading zone prior to loading first fabric sections (10A) onto the first pallet (200). For the purpose of this description and case of understanding, the first pallet holding system (10500) includes a first pallet holder and a linear actuator for movement of the first pallet holder towards the first pallet (200) for holding the first pallet (200). Each first pallet clamp unlocking system (10600) is configured to unlock corresponding clamp of the first pallet (200). For the purpose of this description and case of understanding, each first pallet clamp unlocking system (10600) is considered to be a pneumatic linear actuator (electric linear cylinder). It is also within the scope of the invention to provide any electric linear actuator or other types of linear actuators as first pallet clamp unlocking system (10600) for unlocking the clamps of the first pallet (200). Each first fabric handling system (10800) is configured to grip the first fabric sections (10A) stored or placed on a corresponding first fabric storing zone and load the first fabric sections (10A) onto corresponding face of the first pallet (200). For the purpose of this description and case of understanding, each first fabric handling system (10800) includes a gripper mechanism configured for gripping the first fabric sections (10A), and a first axis linear actuator and a second axis linear actuator configured for movement of the gripper mechanism between the corresponding first fabric storing zone and the first pallet (200).

The first vision system (10900) is configured to capture media (image) of the first pallet (200) with the first fabric sections (10A) that is loaded thereon and send captured media to the master controller module (70000). For the purpose of this description and case of understanding, the first vision system (10900) includes a camera configured for capturing media (image/video) of the first pallet (200) in fabric loaded condition, and a lighting device configured to illuminate the first pallet (200) from a bottom end of the first pallet (200), and a linear actuator configured for moving the lighting device towards the bottom end of the first pallet (200). The master controller module (70000) is configured to detect the presence of the first fabric section (10A) and check the alignment (positioning) of the first fabric section (10A) with respect to corresponding face of the first pallet (200) based on the captured media received from the vision system (10900). When the master controller module (70000) determines that the corresponding first fabric section (10A) is not correctly aligned with respect to corresponding face of the first pallet (200), the master controller module (70000) is configured to operate the corresponding first fabric handling system (10800) to adjust the corresponding first fabric section (10A) with respect to corresponding face of the first pallet (200) thereby aligning the first fabric sections (10A) with respect to corresponding face of the first pallet (200).

Once the first fabric section (10A) is correctly aligned with the corresponding face of the first pallet (200), each of the corresponding first fabric handling system (10800), and the first pallet holder of the first pallet holding system (10500) moves back to its corresponding initial position. Further, each first pallet clamp locking system (10700) are configured to move corresponding clamp of the first pallet (200) against the first fabric sections (10A) thereby locking the corresponding clamp of the first pallet (200) against the first fabric sections (10A) loaded on the first pallet (200). For the purpose of this description and case of understanding, each first pallet clamp locking system (10700) is considered to be a pneumatic linear actuator (electric linear cylinder). It is also within the scope of the invention to provide any electric linear actuator or other types of linear actuators as first pallet clamp locking system (10700) for locking the clamps against the first fabric sections (10A) loaded on the first pallet (200). The first rotary indexer (10400) is configured to rotate the first pallet (200) so as to allow loading of first fabric sections (10A) on remaining faces of the first pallet (200). Once, the first fabric sections (10A) are loaded on all faces of the first pallet (200), the first linear actuating system (10300) is adapted to move the first pallet (200) away from the fabric loading zone and in a direction towards the second pallet handling system (11000).

Further, the second pallet handling system (11000) is configured to grasp the first pallet (200) along with the first fabric sections (10A) from the first indexing platform of the first rotary indexer (10400) and load the first pallet (200) onto the second pallet storing apparatus (11100). For the purpose of this description and case of understanding, the second pallet handling system (11000) includes a second pallet handling mechanism (vacuum cup mechanism) configured for grasping or handling the first pallet (200), and a first axis linear actuator and a second axis linear actuator configured for movement of the second pallet handling mechanism (vacuum cup mechanism) between the first indexing platform of the first rotary indexer (10400) and the second pallet storing apparatus (11100). Further, the second pallet storing apparatus (11100) is adapted to store the second pallets (200) along with the first fabric sections (10A) loaded thereon. For the purpose of this description and case of understanding, the second pallet storing apparatus (11100) is considered to be a pallet stacker apparatus which increases/maintains buffer time required for sewing the first fabric sections (10A) at the sewing machine (11300).

Further, the second pallet handling system (11000) is configured to grasp the first pallet (200) from the second pallet storing apparatus (11100) and place the first pallet (200) along with the first fabric sections (10A) loaded thereon to a table which is located in vicinity of the robotic manipulator (11200). Further, the robotic manipulator (11200) includes end effectors or gripers configured to grip the first pallet (200) and move the first pallet (200) to the sewing machine (11300). Further, the sewing machine (11300) is configured perform first sewing operation on each first fabric sections (10A) while the first pallet (200) is handled or gripped by the robotic manipulator (11200). For the purpose of this description and case of understanding, the first sewing operation performed on each first fabric sections (10A) is considered to be a sewing operation in which sewing is performed at center of the first fabric sections (10A) along a lengthwise direction of the first fabric sections (10A) for affixing the first fabric sections (10A) with each other. It is also within the scope of the invention to consider the first sewing operation as any other type of sewing operation in accordance with fabric type, product type and style of the garment to be manufactured by the system (100). The second vision system (11400) is configured to capture media of the first fabric sections (10A) after the first sewing operation on the first fabric sections (10A) and sends the captured media to the master controller module (70000). The master controller module (70000) is configured to check the sewing quality of the first fabric sections (10A) based on the captured media from the second vision system (11400). For the purpose of this description and case of understanding, the second vision system (11400) includes a camera adapted to capture the media of the first fabric sections (10A) along with the sewing made thereon and send the captured media to the master controller module (70000). The master controller module (70000) determines the sewing quality of the first fabric sections (10A) based on the captured media received from the camera of the second vision system (11400).

When the master controller module (70000) determines that the sewing quality of the first fabric sections (10A) is within the acceptable limits/tolerances, the master controller module (70000) is configured to operate the robotic manipulator (11200) to place or load the first pallet (200) with the sewn first fabric sections (10A) onto a corresponding table which is located in vicinity of the third pallet handling system (11500).

The third pallet handling system (11500) is configured to grasp the first pallet (10A) from the table and load or place the first pallet (10A) onto the conveyor (11600). For the purpose of this description and ease of understanding, the third pallet handling system (11500) includes a third pallet handling mechanism (vacuum cup mechanism) for handling the first pallet (200), and a first axis linear actuator and a second axis linear actuator for movement of the third pallet handling mechanism (vacuum cup mechanism) between the table and the conveyor (11600). Further, the conveyor (11600) is configured to move the first pallet (200) in a direction towards the fourth pallet handling system (11700). Further, the fourth pallet handling system (11700) is configured to grasp the first pallet (200) from the conveyor (11600) and load or place the first pallet (200) onto a second indexing platform of the second rotary indexer (11900) which is mounted onto the second linear actuating system (11800). For the purpose of this description and case of understanding, the fourth pallet handling system (11700) includes a fourth pallet handling mechanism (vacuum cup mechanism) for handling the first pallet (200), and a first axis linear actuator and a second axis linear actuator for movement of the fourth pallet handling mechanism (vacuum cup mechanism) between conveyor (11600) and the second indexing platform of the second rotary indexer (11900). The second linear actuating system (11800) is configured to move the first pallet (200) to a fabric unloading zone which is in vicinity of the second fabric handling systems (12300). The second pallet holding system (12000) is configured to hold the first pallet hold the first pallet (200) when the first pallet (200) enters the fabric unloading zone prior to unloading sewn first fabric sections (10A) from the first pallet (200). For the purpose of this description and case of understanding, the second pallet holding system (12000) includes a second pallet holder and a linear actuator for movement of the second pallet holder towards the first pallet (200) for holding the first pallet (200) against the second indexing platform of the second rotary indexer (11900). Each second pallet clamp unlocking system (12100) is configured to unlock corresponding clamp of the first pallet (200). For the purpose of this description and ease of understanding, each second pallet clamp unlocking system (12100) is considered to be a pneumatic linear actuator (electric linear cylinder). Each second fabric handling system (12300) is configured to grip the sewn first fabric sections (10A) from corresponding face of the first pallet (200) and load the first fabric sections (10A) into the corresponding storage bin (12400). For the purpose of this description and case of understanding, each second fabric handling system (12300) includes a gripper mechanism configured for gripping the sewn first fabric sections (10A), and a linear actuator configured for movement of the gripper mechanism between the first pallet (200) and its initial position, wherein in the initial position, the gripper mechanism of the second fabric handling system (12300) loads the sewn first fabric sections (10A) into the corresponding storage bin (12400). Further, each second pallet clamp locking system (12200) is configured to move corresponding clamp against the first pallet (200) thereby locking corresponding clamp against the first pallet (200). For the purpose of this description and ease of understanding, each second pallet clamp locking system (12200) is considered to be a pneumatic linear actuator (electric linear cylinder). The second rotary indexer (11900) is configured to rotate the first pallet (200) so as to allow unloading of sewn first fabric sections (10A) from remaining faces of the first pallet (200) to the storage bins (12400). Once, the sewn first fabric sections (10A) are unloaded from all faces of the first pallet (200), the second linear actuating system (11800) is configured to move the first pallet (200) away from the fabric unloading zone and in a direction towards the conveyor (11600).

Further, the fourth pallet handling system (11700) is configured for grasping the empty first pallet (200) from the second indexing platform of the second rotary indexer (11900) and load or place the empty first pallet (200) onto the conveyor (11600). Further, the conveyor (11600) is configured to move the empty first pallet (200) in a direction towards the fifth pallet handling system (12500).

The third linear actuating system (12600) is configured to move the first pallet storing apparatus (10100) in a direction towards the fifth pallet handling system (12500). Further, the fifth pallet handling system (12500) is configured for grasping the empty first pallet (200) from the conveyor (11600) and load or place the first pallet (200) onto the first pallet storing apparatus (10100) thereby re-stacking the empty pallets (200) to the first pallet storing apparatus (10100). For the purpose of this description and ease of understanding, the fifth pallet handling system (12500) includes a fifth pallet handling mechanism (vacuum cup mechanism) for handling the first pallet (200), and a first axis linear actuator and a second axis linear actuator for movement of the fifth pallet handling mechanism (vacuum cup mechanism) between conveyor (11600) and the first pallet storing apparatus (10100). The first controller module (12700) is in communication with the master controller module (70000). The first controller module (12700) is configured to operate the linear actuators, rotary actuators, sewing machines, conveyors, and any other actuators and indexers of the first sewing system (10000). The robotic manipulators and visions systems of the first sewing system (10000) are configured to be operated/controlled by the master controller module (70000) and sends signal to the first controller module (12700).

Second Sewing System (200)

The second sewing system (20000) is configured to facilitate a second sewing operation in which sewing is performed at both side ends of the first sewing finished first fabric sections (10A) along a lengthwise direction of the first fabric sections (10A). It is also within the scope of the invention to consider the second sewing operation as any other type of sewing operation in accordance with the fabric type and product type and style of garment to be manufactured by the system (100). In an embodiment, the second sewing system (20000) includes a first pallet storing apparatus (20100), a first pallet handling system (20200), a first conveyor (20300), a first fabric handling system (20400), a first fabric storing system (20500), a second pallet storing apparatus (20600), a second pallet handling system (20700), a second conveyor (20800), a third pallet handling system (20900), at least one fourth pallet handling system (21000), at least one sewing machine (21100), a second fabric handling system (21200), a second fabric storing system (21300), and a second controller module (21400).

The first fabric storing apparatus (20100) is adapted to store a plurality of second pallet bottom member (300A) therein. For the purpose of this description and case of understanding, the first pallet storing apparatus (20100) is considered to be a pallet stacker apparatus. Each second pallet bottom member (300A) is a square shaped pallet with predefined slot patterns (six pairs of non-linear slots). It is also within the scope of the invention to provide the second pallet bottom member (300A) in polygonal shape or any other shape based on requirements and/or the configuration of the system (100). The first pallet handling system (20200) is configured to pick-up/grasp the second pallet bottom member (300A) from the first pallet storing apparatus (20100) and load the second pallet bottom member (300A) onto the first conveyor (20300). For the purpose of this description and ease of understanding, the first pallet handling system (20200) is considered to be a three axis gantry which includes a first pallet handling mechanism (vacuum cup mechanism) configured for grasping and handling the second pallet bottom member (300A), and a first axis linear actuator and a second axis linear actuator and a third axis linear actuator. The first axis (x-axis) linear actuator and the third axis (z-axis) linear actuator are configured for movement of the first pallet handling mechanism (vacuum cup mechanism) between the first pallet storing apparatus (20100) and an entry of the first conveyor (20300). Further, the second axis (y-axis) linear actuator and the third axis (2-axis) linear actuator are configured for movement of the first pallet handling mechanism (vacuum cup mechanism) between the first pallet storing apparatus (20100) and an exit of the second conveyor (20800).

The first conveyor (20300) is configured to move the second pallet bottom member (300A) to a fabric loading zone which is in vicinity of the first fabric handling system (20400). The first fabric storing system (20500) includes a fabric storage bin adapted to store the first sewing finished first fabric section (10A) received from the first sewing system (10000). The first fabric handling system (20400) is configured to grip the first fabric sections (10A) from the fabric storing bin of the first fabric storing system (20500) and load the first fabric sections (10A) onto corresponding the second pallet bottom member (300A) with respect to corresponding predefined slots provided on the second pallet bottom member (300A). For the purpose of this description and case of understanding, the first fabric handling system (20400) includes a gripper mechanism configured for gripping the first fabric sections (10A), and a first axis linear actuator and a second axis linear actuator configured for movement of the gripper mechanism between the fabric storing bin of the first fabric storing system (20500) and the second pallet bottom member (300A). Once the first sewing finished first fabric sections (10A) are loaded onto the second pallet bottom member (300A), the first conveyor (20300) is configured to move the second pallet bottom member (300A) in a direction towards the second pallet storing apparatus (20600).

The second pallet storing apparatus (20600) is configured to store a plurality of second pallet top members (300B) therein. For the purpose of this description and case of understanding, the second pallet storing apparatus (20600) is considered to be a pallet stacker apparatus. Each second pallet top member (300B) is a square shaped pallet with predefined slot patterns (six pairs of non-linear slots) corresponding to the profile of slots provided on the second pallet bottom member (300A). It is also within the scope of the invention to provide the second pallet top member (300A) in polygonal shape or any other shape based on requirements and/or the configuration of the system (100). The second pallet handling system (20700) is configured to pick-up/grasp the second pallet top member (300B) from the second pallet storing apparatus (20600) and load/place the second pallet top member (300B) onto corresponding second pallet bottom member (300A) thereby removably affixing the second pallet top member (300B) with the second pallet bottom member (300A) due to magnetic tapes provided or integrated on the second pallet bottom member (300A) and the second pallet top member (300B). The second pallet bottom section (300A) and the second pallet top section (300B) together forms the second pallet (300A, 300B). The first fabric sections (10A) are sandwiched/disposed between the second pallet bottom member (300A) and the second pallet top member (300B). For the purpose of this description and ease of understanding, the second pallet handling system (20700) is considered to be a three axis gantry which includes a second pallet handling mechanism (vacuum cup mechanism) configured for grasping and handling the second pallet bottom and top members (300A, 300B), and a first axis linear actuator and a second axis linear actuator and a third axis linear actuator. The first axis (y-axis) linear actuator and the third axis (z-axis) linear actuator are configured for movement of the second pallet handling mechanism (vacuum cup mechanism) between the exit of the first conveyor (20300) and an entry of the second conveyor (20800). Further, the second axis (x-axis) linear actuator and the third axis (z-axis) linear actuator are configured for movement of the second pallet handling mechanism (vacuum cup mechanism) between the second pallet storing apparatus (20600) and the exit of the first conveyor (20300).

Once the second pallet top member (300B) is loaded onto the second pallet bottom member (300A), the second pallet handling system (20700) is configured to pick-up/grasp the second pallet bottom and top members (300A, 300B) from the exit of the first conveyor (20300) and load/place the second pallet bottom and top members (300A, 300B) onto the second conveyor (20800). Further, the second conveyor (20800) is configured to move the second pallet bottom and top members (300A, 300B) in a direction towards the third pallet handling system (20900). The third pallet handing system (20900) is configured to pick-up/grasp the second pallet bottom and top members (300A, 300B) from the second conveyor (20800) and load/place the second pallet bottom and top members (300A, 300B) onto the fourth pallet handling system (21000). For the purpose of this description and case of understanding, the third pallet handling system (20900) is considered to be a three axis gantry which includes a third pallet handling mechanism (vacuum cup mechanism) configured for grasping and handling the second pallet bottom and top members (300A, 300B), and a first axis linear actuator and a second axis linear actuator and a third axis linear actuator. The first axis (x-axis) linear actuator and the third axis (z-axis) linear actuator are configured for movement of the third pallet handling mechanism (vacuum cup mechanism) between the second conveyor (20800) and the fourth pallet handling system (21000). Further, the second axis (y-axis) linear actuator and the third axis (z-axis) linear actuator are configured for movement of the third pallet handling mechanism (vacuum cup mechanism) along the second conveyor (20800).

Once the third pallet handling system (20900) loads/places the second pallet bottom and top members (300A, 300B) onto the fourth pallet handling system (21000), the fourth pallet handling system (2100) is configured to move the second pallet bottom and top members (300A, 300B) along with the first fabric sections in a direction towards the sewing machine (21100). For the purpose of this description and case of understanding, the fourth pallet handling system (21000) is considered to be a two axis linear actuating system which includes a bed (platform) configured for handling the second pallet bottom and top members (300A, 300B), and a first axis linear actuator and a second axis linear actuator for movement of the second pallet bottom and top members (300A, 300B) with respect to the sewing machine (21100).

The sewing machine (21100) is configured to perform a second sewing operation on each first fabric sections (10A)

while the second pallet bottom and top members (300A, 300B) is handled or gripped by the fourth pallet handling system (21000). In another embodiment, the second sewing system (20000) includes an auxiliary fourth pallet handling system (21000B) and an auxiliary sewing machine (21100B) for balancing sewing operation of the sewing machine (21100).

Once the second sewing operation on the first fabric sections (10A) is completed by the sewing machine (21100), the fourth pallet handling system (21000) moves the second pallet bottom and top member (300A, 300B) away from the sewing machine (21100) such that the third pallet handling system (20900) is configured to grasp the second pallet top member (300B) and separate the second pallet top member (300B) from the second pallet bottom member (300A) placed on the bed (platform) of the fourth pallet handling system (21000). Further, the third pallet handling system (20900) is configured to move the second pallet top member (300B) away from the fourth pallet handling system (21000) and place the second pallet top member (300B) onto the second conveyor (20800). Thereafter, the second conveyor (20800) is configured to move the second pallet top member (300B) towards the second pallet storing apparatus (20600). Further, the second pallet handling system (20700) is configured to pickup/grasp the second pallet top member (300B) from the second conveyor (20800) and load/place the second pallet top member (300B) onto the second pallet storing apparatus (20600) thereby restacking the second pallet top member (300B) onto the second pallet storing apparatus (20600).

Further, the third pallet handling system (20900) is configured to pickup/grasp the second pallet bottom member (300A) from the bed/platform of the fourth pallet handling system (21000) and load/place the second pallet bottom member (300A) onto the second conveyor (20800). Thereafter, the second conveyor (20800) is configured to move the second pallet bottom member (300A) along with the second sewing finished first fabric sections (10A) to a fabric unloading zone in vicinity of the second fabric handling system (21200).

The second fabric handling system (21200) is configured to grip corresponding first fabric section (10A) from the second pallet bottom member (300A) and unload/place the second sewing finished first fabric section (10A) into a fabric storing bin of the second fabric storing system (21300). For the purpose of this description and case of understanding, the second fabric handling system (21200) includes a gripper mechanism configured for gripping the first fabric sections (10A), and a first axis linear actuator and a second axis linear actuator configured for movement of the gripper mechanism between the second pallet bottom member (300A) and the fabric storing bin of the second fabric storing system (21300). Once the second sewing finished first fabric sections (10A) are unloaded from the second pallet bottom member (300A), the second conveyor (20800) is configured to move the empty second pallet bottom member (300A) in a direction towards the exit of the second conveyor (20800) adjacent to the first pallet storing apparatus (20100). When the empty second pallet bottom member (300A) reaches the exit of the second conveyor (20800), the first pallet handling system (20200) is configured to grasp the empty second pallet bottom member (300A) from the second conveyor (20800) and places the second pallet bottom member (300A) into the first pallet storing apparatus (20100) thereby restacking the second pallet bottom member (300A) into the first pallet storing apparatus (20100). The second controller module (21400) is in communication with the master controller module (70000). The second controller module (21400) is configured to operate the linear actuators, rotary actuators, conveyors, sewing machine and any other actuators of the second sewing system (20000). The robotic manipulators and visions systems of the second sewing system (20000) are configured to be operated/controlled by the master controller module (70000) and sends the signal to the second controller module (21400).

Third Sewing System (30000)

The third sewing system (30000) is configured to facilitate a third sewing operation in which a sewing is performed at the interface (side ends) of the first fabric section (10A) and corresponding portion of the second fabric sections (10B). It is also within the scope of the invention to consider the third sewing operation as any other type of sewing operation in accordance with the fabric type, product type and style of garment to be manufactured by the system (100). Further, the second fabric section (10B) is considered to be a body fabric section of the garment (underwear).

In an embodiment, the third sewing system (30000) includes a pallet storing apparatus (30100), a first pallet handling system (30200), a rotary indexer (30300), a first fabric storing system (30400), a first pallet holding system (30500), a first pallet clamp unlocking system (30600), a first fabric handling system (30700), a first pallet clamp locking system (30800), a second fabric storing system (30900), a second pallet holding system (31000), a pair of second pallet clamp unlocking systems (31100), a second fabric handling system (31200), a fabric folding system (31300), a pair of second pallet clamp locking systems (31400), a first vision system (31500), a third pallet holding system (31600), a pair of third pallet clamp unlocking systems (31700), a first robotic manipulator (31800), a pair of a third pallet clamp locking systems (31900), a second pallet handling system (32000), a second robotic manipulator (32100), a sewing machine (32200), a second vision system (32300), a third controller module (32400) and a fabric holding system (32500). The pallet storing apparatus (30100) is adapted to store a plurality of third pallets (400) therein. For the purpose of this description and case of understanding, the pallet storing apparatus (30100) is considered to be a pallet stacker apparatus. The first pallet handling system (30200) is configured to pick-up/grasp the third pallet (400) from the pallet storing apparatus (30100) and load the third pallet (400) onto an indexing platform of the rotary indexer (30300). For the purpose of this description and ease of understanding, the first pallet handling system (30200) includes a first pallet handling mechanism (vacuum cup mechanism) configured for grasping and handling the third pallet (400), and a first axis linear actuator and a second axis linear actuator configured for movement of the first pallet handling mechanism (vacuum cup mechanism) between the pallet storing apparatus (30100) and the indexing platform of the rotary indexer (30300). Further, the rotary indexer (30300) includes a rotary actuator adapted to rotate the indexing platform of the rotary indexer (30300).

Once the third pallet (400) is loaded/placed onto the indexing platform, the rotary indexer (30300) is configured to rotate the indexing platform along with the third pallet (400) to a first fabric loading zone which is in vicinity of the first fabric handling system (30700). The first fabric storing system (30400) includes a fabric storing bin, a bin swapping mechanism and a bin transporting mechanism. The fabric storing bin of the first fabric storing system (30400) is adapted to store the sewn first fabric section (10A) received from the second sewing system (20000). The fabric storing bin of the first fabric storing system (30400) is mounted onto the bin transporting mechanism. The bin swapping mechanism is configured to swap the fabric storing bin of the first fabric storing system (30400) of the third sewing system (30000) with the corresponding fabric storing bin of the second fabric storing system (21300) of the second sewing system (20000) when the sewn first fabric section (10A) is not present in the fabric storing bin of the first fabric storing system (30400). The bin swapping mechanism includes a linear actuator, a rotary actuator coupled to the linear actuator, and a pair of grippers coupled to the rotary actuator. To swap the fabric storing bins when the first fabric section (10A) is not present in the fabric storing bin, each of the bin transporting mechanism of the second and third sewing system (20000, 30000) is adapted to move the fabric storing bins closer to each other. Thereafter, the linear actuator of the bin swapping mechanism moves the grippers towards the fabric storing bins, and one of the gripper is configured to grip fabric storing bin of the third sewing system (30000) and another gripper is configured to grip the fabric storing bin of the second sewing system (20000). Thereafter, the rotary actuator of the bin swapping mechanism is configured to rotate thereby changing swapping the empty fabric storing bin of the third sewing system (30000) with the fabric storing bin of the second sewing system (20000).

Once the fabric storing bins are swapped, the grippers of the bin swapping mechanism is configured to disengage the fabric storing bins, and the linear actuator moves the grippers of the bin swapping mechanism to its initial position. Further, the bin transporting mechanism of the second sewing system (20000) is configured to transport the empty fabric storing bin to the second fabric storing system (21300) for storing sewn first fabric sections (10A). Furthermore, the bin transporting mechanism of the third sewing system (30000) is configured to move the fabric storing bin along with the sewn first fabric section (10A) in a direction towards the first fabric handling system (30700). For the purpose of this description and case of understanding, each of the bin transporting mechanism of the second and third sewing systems (20000, 30000) is considered to be a linear actuator. However, it is also within the scope of the invention to consider the bin transporting mechanism of the second and third sewing systems (20000, 30000) as conveyors or any other floor moving mechanisms without otherwise deterring the intended function of the bin transporting mechanism as can be deduced from the description and corresponding drawings.

The first pallet holding system (30500) is configured to hold the third pallet (400) when the third pallet (400) enters the first fabric loading zone prior to loading sewn first fabric sections (10A) onto the third pallet (400). For the purpose of this description and ease of understanding, the first pallet holding system (30500) includes a first pallet holder and a linear actuator for movement of the first pallet holder towards the third pallet (400) for holding the third pallet (400). The first pallet clamp unlocking system (30600) is configured to unlock corresponding clamp (center clamp) of the third pallet (400). For the purpose of this description and case of understanding, the first pallet clamp unlocking system (30600) is considered to be a pneumatic linear actuator (electric linear cylinder). It is also within the scope of the invention to provide any electric linear actuator or other types of linear actuators as first pallet clamp unlocking system (30600) for unlocking the corresponding clamp of the third pallet (400).

The first fabric handling system (30700) is configured to grip the first fabric section (10A) from the fabric storing bin of the first fabric storing system (30400) and load the first fabric section (10A) onto the third pallet (400). For the purpose of this description and case of understanding, each first fabric handling system (30700) includes a gripper mechanism configured for gripping the first fabric sections (10A), and a first axis linear actuator and a second axis linear actuator configured for movement of the gripper mechanism between the fabric storing bin of the first fabric storing system (30400) and the third pallet (400).

The first pallet clamp locking system (30800) is configured to move the corresponding clamp of the third pallet (400) against the first fabric sections (10A) thereby locking the corresponding clamp of the third pallet (400) against the first fabric sections (10A) loaded on the third pallet (400). For the purpose of this description and case of understanding, each first pallet clamp locking system (30800) is considered to be a pneumatic linear actuator (electric linear cylinder). It is also within the scope of the invention to provide any electric linear actuator or other types of linear actuators as first pallet clamp locking system (30800) for locking the clamps against the first fabric sections (10A) loaded on the third pallet (400). Once the first fabric section (10A) is locked onto the third pallet (400), the first pallet holder of the first pallet holding system is configured to disengage the third pallet (400) when the linear actuator moves the first pallet holder back to its initial position.

Thereafter, the rotary indexer (30300) rotates the indexing platform along with the third pallet (400) and the first fabric section (10A) loaded thereon to a second fabric loading zone in which the third pallet (400) is positioned above second fabric section (10B) that is stored in the second fabric storing system (30900). For the purpose of this description and case of understanding, the second fabric storing system (30900) is considered to be a fabric stacker which is configured to store second fabric sections (10B) thereof. Once the third pallet (400) is positioned above the second fabric storing system (30900), the second pallet holding system (31000) is configured to hold the third pallet (400) when the third pallet (400) enters the second fabric loading zone prior to loading second fabric sections (10B) onto the third pallet (400). For the purpose of this description and case of understanding, the second pallet holding system (31000) includes a second pallet holder and a linear actuator for movement of the second pallet holder towards the third pallet (400) for holding the third pallet (400) at the second fabric loading zone. Each second pallet clamp unlocking system (31100) is configured to unlock corresponding clamp (left side/right side clamp) of the third pallet (400). For the purpose of this description and case of understanding, each second pallet clamp unlocking system (31100) is considered to be a pneumatic linear actuator (electric linear cylinder). It is also within the scope of the invention to provide any electric linear actuator or other types of linear actuators as second pallet clamp unlocking system (31100) for unlocking the corresponding clamp of the third pallet (400).

Once the clamps of the third pallet (400) is unlocked by the second pallet clamp unlocking system (31100), the second fabric handling system (31200) is configured to grip and hold both side ends (overhangs) of the second fabric section (10B). For the purpose of this description and case of understanding, the second fabric handling system (31200) includes a pair of grippers configured for gripping and holding the both side ends (overhangs) of the second fabric section (10B), and a pair of linear actuators for movement of the gripers towards and away from second fabric section (10B). Further, the fabric folding system (31300) is configured to fold the side end portions of the second fabric section (10B) and move the side end portions of the second fabric section (10B) to contact corresponding side ends of the first fabric section (10A). For the purpose of this description and case of understanding, the fabric folding system (31300) includes a pair of first roll gripper, a pair of seconds roll grippers, a pair of rotary actuators, a pair of first linear actuators and a second linear actuator. Each rotary actuator is coupled to corresponding roll grippers. Each first linear actuator is coupled to corresponding roll grippers. The second linear actuator is coupled to first and second linear actuators. The second linear actuator is configured to move the first and second roll grippers in a direction towards the second fabric section (10B) such that the roll grippers allows the second fabric section (10B) to pass therethrough. Further, the first and second roll grippers are configured to grip corresponding side ends of the second fabric section (10B). Thereafter, each rotary actuator is configured to rotate corresponding roll gripper to fold the side ends of the second fabric section (10B). Further, each first linear actuator is configured to move corresponding roll gripper closer to each other such that folded side ends of the second fabric section (10B) moves in a direction towards the side ends of the first fabric section (10A). Once the side ends of the second fabric section (10B) is moved near to or engages the side ends of the first fabric section (10A), the roll gripper disengages the second fabric section (10B) and the second linear actuator moves the roll grippers away from the second fabric portion (10B).

Furthermore, the grippers of second fabric handling system (31200) disengages from the second fabric section (10B) when the fabric folding system (31300) engages the second fabric section (10B). Thereafter, each second pallet clamp locking system (31400) is configured to move the corresponding clamp (side clamp) of the third pallet (400) against the second fabric sections (10B) thereby locking the corresponding clamp of the third pallet (400) against the second fabric sections (10B) loaded on the third pallet (400). For the purpose of this description and ease of understanding, each second pallet clamp locking system (31400) is considered to be a pneumatic linear actuator (electric linear cylinder). It is also within the scope of the invention to provide any electric linear actuator or other types of linear actuators as each second pallet clamp locking system (31400) for locking the clamps against the second fabric sections (10B) loaded on the third pallet (400). Once the second fabric section (10B) is locked onto the third pallet (400), the second pallet holder of the second pallet holding system (31000) is configured to disengage the third pallet (400) when the linear actuator moves the second pallet holder back to its initial position. Thereafter, the rotary indexer (30300) rotates the indexing platform along with the third pallet (400) to a fabric adjustment/alignment zone which is in vicinity of the first robotic manipulator (31800).

When the third pallet (400) along with first and second fabric sections (10A, 10B) reaches the fabric adjustment/alignment zone, a linear actuator of the fabric holding system (32500) is configured to move a fabric holder in a direction towards the second fabric section (10B) to engage the fabric holder with the second fabric section (10B) thereby supporting the second fabric section (10B). Further, the third pallet holding system (31600) is configured to hold the third pallet (400). For the purpose of this description and case of understanding, the third pallet holding system (31600) includes a third pallet holder and a linear actuator for movement of the third pallet holder towards the third pallet (400) for holding the third pallet (400). Each third pallet clamp unlocking system (31700) is configured to unlock corresponding clamp (side clamp) of the third pallet (400). For the purpose of this description and case of understanding, each third pallet clamp unlocking system (31700) is considered to be a pneumatic linear actuator (electric linear cylinder). It is also within the scope of the invention to provide any electric linear actuator or other types of linear actuators as third pallet clamp unlocking system (31700) for unlocking the clamps of the third pallet (400). Once all clamps of the third pallet (400) are unlocked, the first vision system (31500) is configured to capture media of the third pallet (400) along with the first and second fabric sections (10A, 10B) loaded thereon and sends the captured media to the master controller module (70000). For the purpose of this description and ease of understanding, the first vision system (31500) includes a first vision sensor (first camera), a lighting device and a linear actuator. The first vision sensor (first camera) is configured for capturing media (image) of the third pallet (400) along with the first and second fabric sections (10A, 10B) loaded thereon. The lighting device configured to illuminate the third pallet (400) from a bottom end of the third pallet (400). The linear actuator is configured for moving the lighting device towards the bottom end of the third pallet (400). The master controller module (70000) is configured to detect the presence of the first and second fabric sections (10A, 10B) and determine the alignment (positioning) of the second fabric section (10B) with respect to first fabric section (10A) by determining the reference points (coordinates) of the first fabric section (10A) based on the captured media received from the first vision system (31500). Once, the first vision sensor (first camera) captures media of the third pallet (400) along with the first and second fabric sections (10A, 10B), the linear actuator moves the lighting device back to its initial position and the lighting device is switched OFF.

The end effectors of the first robotic manipulator (31800) are configured to adjust the second fabric section (10B) with respect to the first fabric section (10A) thereby aligning the side ends of the second fabric section (10B) with respect to corresponding side ends of the first fabric section (10A) when the first robotic manipulator (31800) is operated by the master controller module (70000) based on the reference points (coordinates) of the first fabric section (10A) determined by the master controller module (70000) in accordance to the captured media received from the first vision system (31500).

Once the second fabric section (10B) is aligned with the first fabric section (10A), each third pallet clamp locking system (31900) is configured to move corresponding clamp (side clamp) of the third pallet (400) against the second fabric sections (10B) thereby locking the corresponding clamp of the third pallet (400) against the second fabric sections (10B) loaded on the third pallet (400). For the purpose of this description and ease of understanding, each third pallet clamp locking systems (31900) is considered to be a pneumatic linear actuator (electric linear cylinder). It is also within the scope of the invention to provide any electric linear actuator or other types of linear actuators as third pallet clamp locking systems (31900) for locking the clamps against the second fabric sections (10B) loaded on the third pallet (400). The linear actuator of the fabric holding system (32500) moves the fabric holder away from the second fabric section (10B) thereby moving the fabric holder to its initial position. The linear actuator of the third pallet holding system (31600) moves the third pallet holder away from the third pallet (400) thereby moving the third pallet holder back to its initial position. Thereafter, the rotary indexer (30300) is configured to rotate the indexing platform along with the pallet load thereon to a first pallet unloading zone which is in vicinity of the second pallet handling system (32000).

The second pallet handling system (32000) is configured to grasp the third pallet (400) along with the first and second fabric sections (10A, 10B) from the indexing platform of the rotary indexer (30300) and move the third pallet (400) to a second pallet unloading zone which is in vicinity of the second robotic manipulator (32100). For the purpose of this description and ease of understanding, the second pallet handling system (32000) includes a second pallet handling mechanism (vacuum cup mechanism) configured for grasping or handling the third pallet (400), and a first axis linear actuator and a second axis linear actuator configured for movement of the second pallet handling mechanism (vacuum cup mechanism) between the rotary indexer (30300) and the second pallet unloading zone adjacent to the second robotic manipulator (32100).

Once the third pallet (400) reaches the second pallet unloading zone, end effectors or grippers of the second robotic manipulator (32100) is configured to grasp the third pallet (400) from the second pallet handling system (32000) and move the third pallet (400) to the sewing machine (32200). Further, the sewing machine (32200) is configured perform third sewing operation at the interface (side ends) of the first and second fabric sections (10A, 10B) while the third pallet (400) is handled or gripped by the second robotic manipulator (32100).

The second vision system (32300) is configured to capture media of the third sewing finished first and second fabric sections (10A, 10B) after the third sewing operation on the first and second fabric sections (10A, 10B) and sends the captured media to the master controller module (70000). The master controller module (70000) is configured to check the sewing quality of the third sewing finished first and second fabric sections (10A, 10B) based on the captured media from the second vision system (32300). For the purpose of this description and ease of understanding, the second vision system (32300) includes a vision sensor (camera) adapted to capture the media of the first and second fabric sections (10A, 10B) along with the sewing made thereon and send the captured media to the master controller module (70000). The master controller module (70000) determines the sewing quality of the first and second fabric sections (10A, 10B) based on the captured media received from the vision sensor/camera of the second vision system (32300).

When the master controller module (70000) determines that the sewing quality of the first and second fabric sections (10A) is within the acceptable limits/tolerances, the master controller module (70000) is configured to operate the second robotic manipulator (32100) to place the third pallet (400) on a table or conveyor with pallet clamp unlocking system located adjacent to first robotic manipulators of the fourth sewing system (40000). The pallet unlocking system is configured to unlock the clamps of the third pallet (400) so as to allow pick-up of the first and second fabric sections (10A, 10B) by the first robotic manipulators of the fourth sewing system (40000). The third controller module (32400) is in communication with the master controller module (70000). The third controller module (32400) is configured to operate the linear actuators, sewing machine, indexers, rotary actuators and any other actuators of the third sewing system (30000). The robotic manipulators and visions systems of the third sewing system (30000) are configured to be operated by the master controller module (70000) and sends the signal to the third controller module (32400).

Fourth Sewing System (40000)

The fourth sewing system (40000) is configured to facilitate a fourth sewing operation in which a sewing is performed at the interface of the first and second fabric sections (10A, 10B) and third fabric sections (10C). It is also within the scope of the invention to consider the fourth sewing operation as any other type of sewing operation in accordance with the fabric type, product type and style of garment to be manufactured by the system (100). Further, the third fabric section (10C) is considered to be a gusset (bottom section) of the garment (underwear).

The fourth sewing system (40000) is configured to facilitate a third sewing operation in which a third fabric section (10C) is sewed with respect to the second fabric section (10B). In an embodiment, the fourth sewing system (40000) includes a pallet storing apparatus (40100), a first pallet handling system (40200), a rotary indexer (40300), a first fabric storing system (40400), a first pallet holding system (40500), a first pallet clamp unlocking system (40600), a first fabric handling system (40700), a first pallet clamp locking system (40800), a second pallet holding system (40900), a pair of second pallet clamp unlocking systems (41000), a first vision system (41100), a pair of first robotic manipulators (41200), a pair of second pallet clamp locking systems (41300), a second vision system (41400), a third pallet holding system (41500), a pair of third pallet clamp unlocking systems (41600), a second robotic manipulator (41700), a pair of a third pallet clamp locking systems (41800), a second pallet handling system (41900), a third robotic manipulator (42000), a sewing machine (42100), a third vision system (42200), a fourth controller module (42300) and a fabric holding system (42400).

The pallet storing apparatus (40100) is adapted to store a plurality of fourth pallets (500) therein. For the purpose of this description and ease of understanding, the pallet storing apparatus (40100) is considered to be a pallet stacker apparatus. The first pallet handling system (40200) is configured to pick-up/grasp the fourth pallet (500) from the pallet storing apparatus (40100) and load the fourth pallet (500) onto an indexing platform of the rotary indexer (40300). For the purpose of this description and ease of understanding, the first pallet handling system (40200) includes a first pallet handling mechanism (vacuum cup mechanism) configured for grasping and handling the fourth pallet (500), and a first axis linear actuator and a second axis linear actuator configured for movement of the first pallet handling mechanism (vacuum cup mechanism) between the pallet storing apparatus (40100) and the indexing platform of the rotary indexer (40300). Further, the rotary indexer (40300) includes a rotary actuator adapted to rotate the indexing platform of the rotary indexer (40300).

Once the fourth pallet (500) is loaded/placed onto the indexing platform, the rotary indexer (40300) is configured to rotate the indexing platform along with the fourth pallet (500) to a first fabric loading zone which is in vicinity of the first fabric handling system (40700). The first fabric storing system (40400) includes a fabric storing bin or a stacker apparatus adapted to store third fabric sections (10C) therein.

The first pallet holding system (40500) is configured to hold the fourth pallet (500) when the fourth pallet (500) enters the first fabric loading zone prior to loading third fabric sections (10C) onto the fourth pallet (500). For the purpose of this description and ease of understanding, the first pallet holding system (40500) includes a first pallet holder and a linear actuator for movement of the first pallet holder towards the fourth pallet (500) for holding the fourth pallet (500). The first pallet clamp unlocking system (40600) is configured to unlock corresponding clamp (center clamp) of the fourth pallet (500). For the purpose of this description and ease of understanding, the first pallet clamp unlocking system (40600) is considered to be a pneumatic linear actuator (electric linear cylinder). It is also within the scope of the invention to provide any electric linear actuator or other types of linear actuators as first pallet clamp unlocking system (40600) for unlocking the corresponding clamp of the fourth pallet (500).

The first fabric handling system (40700) is configured to grip the third fabric section (10C) from the fabric storing bin or fabric stacker apparatus of the first fabric storing system (40400) and load the third fabric section (10C) onto the fourth pallet (500). For the purpose of this description and ease of understanding, the first fabric handling system (40700) includes a gripper mechanism configured for gripping the third fabric sections (10C), and a first axis linear actuator and a second axis linear actuator configured for movement of the gripper mechanism between the fabric storing bin or fabric stacker apparatus of the first fabric storing system (40400) and the fourth pallet (500).

The first pallet clamp locking system (40800) is configured to move the corresponding clamp (central clamp) of the fourth pallet (500) against the third fabric section (10C) thereby locking the corresponding clamp of the fourth pallet (500) against the third fabric section (10C) loaded on the fourth pallet (500). For the purpose of this description and case of understanding, each first pallet clamp locking system (40800) is considered to be a pneumatic linear actuator (electric linear cylinder). It is also within the scope of the invention to provide any electric linear actuator or other types of linear actuators as first pallet clamp locking system (40800) for locking the clamps against the third fabric sections (10C) loaded on the fourth pallet (500). Once the third fabric section (10C) is locked onto the fourth pallet (500), the first pallet holder of the first pallet holding system (40500) is configured to disengage the fourth pallet (500) when the linear actuator moves the first pallet holder back to its initial position.

Thereafter, the rotary indexer (40300) rotates the indexing platform along with the fourth pallet (500) and the third fabric section (10C) loaded thereon to a second fabric loading zone which is in vicinity of the first robotic manipulators (41200). The second pallet holding system (40900) is configured is configured to hold the fourth pallet (500) when the fourth pallet (500) enters the second fabric loading zone prior to loading first and second fabric sections (10A, 10B) onto the fourth pallet (500) respect to the third fabric section (10C). For the purpose of this description and case of understanding, the second pallet holding system (40900) includes a second pallet holder and a linear actuator for movement of the second pallet holder towards the fourth pallet (500) for holding the fourth pallet (500). Each second pallet clamp unlocking system (41000) is configured to unlock corresponding clamp (side clamp) of the fourth pallet (500). For the purpose of this description and ease of understanding, the second pallet clamp unlocking system (41000) is considered to be a pneumatic linear actuator (electric linear cylinder). It is also within the scope of the invention to provide any electric linear actuator or other types of linear actuators as the second pallet clamp unlocking system (41000) for unlocking the corresponding side clamp of the fourth pallet (500).

Further, the first vision system (41100) is configured to capture media (image) of the sewn first and second fabric sections (10A, 10B) located on the third pallet (400) that is placed on the table or conveyor adjacent to the first robotic manipulators (41200), and accordingly the first vison system (41100) sends the captured media to the master controller module (70000). For the purpose of this description and case of understanding, the first vision system (41100) includes a first vision sensor (first camera) configured for capturing media (image) of the first and second fabric sections (10A, 10B) loaded on the third pallet (400). Further, the master controller module (70000) is configured to determine coordinates of the first and second fabric sections (10A, 10B) corresponding to predefined portions of the first and second fabric sections (10A, 10B) to be gripped by the first robotic manipulators and placement of the first and second fabric sections (10A, 10B) onto the fourth pallet (500) with respect to the third fabric section (10C). Thereafter, the first robotic manipulators (41200) is configured to grip the predefined portions of the sewn first and second sections (10A, 10B) and place the first and second sections (10A, 10B) onto the fourth pallet (500) with respect to the third section (10C) when the first robotic manipulators (41200) is operated by the master controller module (70000) based on the coordinates of the first and second fabric sections (10A, 10B) as determined by the master controller module (70000).

Once the first and second fabric sections (10A, 10B) is loaded onto the fourth pallet (500) with respect to the third fabric section (10C), each second pallet clamp locking system (41300) is configured to move the corresponding clamp (side clamp) of the fourth pallet (500) against the first and second fabric sections (10A, 10B) thereby locking the corresponding clamp of the fourth pallet (400) against the first and second fabric sections (10A, 10B) loaded on the fourth pallet (500) with respect to the third fabric section (10C). For the purpose of this description and ease of understanding, each second pallet clamp locking system (41300) is considered to be a pneumatic linear actuator (electric linear cylinder). It is also within the scope of the invention to provide any electric linear actuator or other types of linear actuators as second pallet clamp locking system (41300) for locking the side clamps against the first and second fabric sections (10A, 10B) loaded on the fourth pallet (500) with respect to the third fabric section (10C).

Once the first and second fabric section (10A, 10B) is locked onto the fourth pallet (400) with respect to the third fabric section (10C), the second pallet holder of the second pallet holding system (40900) is configured to disengage the fourth pallet (500) when the linear actuator moves the second pallet holder back to its initial position. Thereafter, the rotary indexer (40300) rotates the indexing platform along with the fourth pallet (400) to a fabric adjustment/alignment zone which is in vicinity of the second robotic manipulator (41700).

Once the fourth pallet (400) enters the fabric adjustment/alignment zone, the third pallet holding system (41500) is configured to hold the fourth pallet (500). For the purpose of this description and ease of understanding, the third pallet holding system (41500) includes a third pallet holder and a linear actuator for movement of the third pallet holder towards the fourth pallet (500) for holding the fourth pallet (500). Further, a linear actuator of the fabric holding system (42400) moves a fabric holder in a direction toward the first, second and third fabric sections (10A, 10B, 10C) to engage the fabric holder with the corresponding portions of the fabric sections. Once, the third pallet holder of the third pallet holding system (41500) holds the fourth pallet (500) and the fabric holder of the fabric holding system (42400) supports the corresponding portions of the fabric sections, each third pallet clamp unlocking system (41600) is configured to unlock all clamps of the fourth pallet (500). For the purpose of this description and case of understanding, each third pallet clamp unlocking system (41600) is considered to be a pneumatic linear actuator (electric linear cylinder). It is also within the scope of the invention to provide any electric linear actuator or other types of linear actuators as third pallet clamp unlocking system (41600) for unlocking the side clamps of the fourth pallet (500).

Once all clamps of the fourth pallet (500) are unlocked, the second vision system (41400) is configured to capture media (image/picture) of the first, second and third fabric sections (10A, 10B, 10C) loaded on the fourth pallet (500) and sends the captured media to the master controller module (70000). For the purpose of this description and case of understanding, the second vision system (41400) includes a second vision sensor (second camera), a lighting device and a linear actuator. The second vision sensor (second camera) is configured for capturing media (image) of the fourth pallet (400) along with the first, second and third fabric sections (10A, 10B, 10C) loaded thereon. The lighting device is configured to illuminate the fourth pallet (500) from a bottom end of the fourth pallet (500). The linear actuator is configured for moving the lighting device towards the bottom end of the fourth pallet (500). The master controller module (70000) is configured to detect the presence of the first, second and third fabric sections (10A, 10B, 10C) and determines the alignment (positioning) of the first and second fabric sections (10A, 10B) with respect to third fabric section (10C) by determining the reference points (coordinates) of the third fabric section (10C) based on the captured media received from the second vision system (41400).

Once, the second vision sensor (second camera) captures media of the fourth pallet (500) along with the first, second and third fabric sections (10A, 10B, 10C), the linear actuator moves the lighting device back to its initial position and the lighting device is switched OFF.

The end effectors of the second robotic manipulator (41700) is configured to adjust the sewn first and second fabric sections (10A, 10B) with respect to the third fabric section (10C) thereby aligning corresponding interfacing portion the first and second fabric sections (10A, 10B) with respect to corresponding interfacing portion of the third fabric section (10C) when the second robotic manipulator (41700) is operated by the master controller module (70000) based on the reference points (coordinates) of the third fabric section (10C) determined by the master controller module (70000) in accordance to the captured media received from the second vision system (41400).

Once the first and second fabric sections (10A, 10B) is aligned with the third fabric section (10C), each third pallet clamp locking system (41800) is configured to move corresponding all clamps of the fourth pallet (500) against the first and second fabric sections (10A, 10B) thereby locking the corresponding clamp of the fourth pallet (500) against the first and second fabric sections (10A, 10B) loaded on the fourth pallet (500). For the purpose of this description and case of understanding, each third pallet clamp locking systems (41800) is considered to be a pneumatic linear actuator (electric linear cylinder). It is also within the scope of the invention to provide any electric linear actuator or other types of linear actuators as third pallet clamp locking systems (41800) for locking the clamps against the first and second fabric sections (10A, 10B) loaded on the fourth pallet (500). Further, the fabric holder and the third pallet holder moves back to its initial positions. Thereafter, the rotary indexer (40300) is configured to rotate the indexing platform along with the fourth pallet (500) loaded thereon to a first pallet unloading zone which is in vicinity of the second pallet handling system (41900).

The second pallet handling system (41900) is configured to grasp the fourth pallet (500) along with the first, second and third fabric sections (10A, 10B, 10C) from the indexing platform of the rotary indexer (40300) and move the fourth pallet (500) to a second pallet unloading zone which is in vicinity of the third robotic manipulator (42000). For the purpose of this description and case of understanding, the second pallet handling system (41900) includes a second pallet handling mechanism (vacuum cup mechanism) configured for grasping or handling the fourth pallet (500), and a first axis linear actuator and a second axis linear actuator configured for movement of the second pallet handling mechanism (vacuum cup mechanism) between the rotary indexer (40300) and the second pallet unloading zone adjacent to the third robotic manipulator (42000).

Once the fourth pallet (500) reaches the second pallet unloading zone, end effectors or grippers of the third robotic manipulator (42000) is configured to grasp the fourth pallet (500) from the second pallet handling system (41900) and move the fourth pallet (500) to the sewing machine (42100). Further, the sewing machine (42100) is configured perform a fourth sewing operation at the interface of the first and second fabric sections (10A, 10B), and the third fabric section (10C) while the fourth pallet (500) is handled or gripped by the third robotic manipulator (42000).

The third vision system (42200) is configured to capture media of the first, second and third fabric sections (10A, 10B, 10C) while the third sewing operation is performed on the first, second and third fabric sections (10A, 10B, 10C) and sends the captured media to the master controller module (70000). The master controller module (70000) is configured to check the sewing quality of the first, second and third fabric sections (10A, 10B, 10C) based on the captured media from the third vision system (42200). For the purpose of this description and case of understanding, the third vision system (42200) includes a vision sensor (camera) adapted to capture the media of the first, second and third fabric sections (10A, 10B, 10C) along with the sewing made thereon and send the captured media to the master controller module (70000). The master controller module (70000) determines the sewing quality performed on the first, second and third fabric sections (10A, 10B, 10C) based on the captured media received from the vision sensor/camera of the third vision system (42200).

When the master controller module (70000) determines that the sewing quality of the first and second fabric sections (10A, 10B) with the third fabric section (10C) is within the acceptable limits/tolerances, the master controller module (70000) is configured to operate the third robotic manipulator (4200) to place the fourth sewing finished first, second and third fabric sections (10A, 10B, 10C) on a table or a conveyor located in the fifth sewing system (50000). The fourth controller module (42300) is in communication with the master controller module (70000). The fourth controller module (42300) is configured to operate the linear actuators, rotary actuators, indexer, sewing machine and any other actuators of the fourth sewing system (40000). The robotic manipulators and visions systems of the fourth sewing system (40000) are configured to be operated by the master controller module (70000) and sends the signal to the fourth controller module (42300).

Fifth Sewing System (50000)

The fifth sewing system (50000) is configured to facilitate a fifth sewing operation in which a sewing is performed at corresponding portion (legs) of the fourth sewing finished first, second and third fabric sections (10A, 10B, 10C). It is also within the scope of the invention to consider the fifth sewing operation as any other type of sewing operation in accordance with the fabric type, product type and style of garment to be manufactured by the system (100). In an embodiment, the fifth sewing system (50000) includes a main robotic manipulator (50100), a first vision system (50200), a main hemming machine (50300), a second vision system (50400) and a fifth controller module (50500). The first vision system (50200) is configured to capture media (image) of the fourth sewing finished first, second and third fabric sections (10A, 10B, 10C) placed on the table or conveyor (50500) located adjacent to the main robotic manipulator (50100), and accordingly the first vison system (50200) sends the captured media to the master controller module (70000). For the purpose of this description and case of understanding, the first vision system (50200) includes a first vision sensor (first camera) configured for capturing media (image) of the fourth sewing finished first, second and third fabric sections (10A, 10B, 10C) loaded on placed on the table or conveyor (50500). Further, the master controller module (70000) is configured to determine co-ordinates of the fourth sewing finished first, second and third fabric sections (10A, 10B, 10C) corresponding to predefined portions of the fourth sewing finished first, second and third fabric sections (10A, 10B, 10C) to be gripped by end effectors/grippers of the main robotic manipulator (50100) and feeding of legs of fourth sewing finished first, second and third fabric sections (10A, 10B, 10C) to the main hemming machine (50300) by using the main robotic manipulator (50100). Thereafter, the end effectors/grippers of the main robotic manipulator (50100) is configured to grip the predefined portions of the fourth sewing finished first, second and third fabric sections (10A, 10B, 10C) from the table or conveyor (50500) and feed the legs of fourth sewing finished first, second and third fabric sections (10A, 10B, 10C) to the main hemming machine (50300) when the main robotic manipulator (50100) is operated by the master controller module (70000) based on the co-ordinates of the fourth sewing finished first, second and third fabric sections (10A, 10B, 10C) as determined by the master controller module (70000).

Once fifth sewing operation is completed on corresponding portion of the fourth sewing finished first, second and third fabric sections (10A, 10B, 10C), the end effector/gripper of the main robotic manipulator (50100) is configured to grasp the fourth sewing finished first, second and third fabric sections (10A, 10B, 10C), and feed another corresponding portion of the fourth sewing finished first, second and third fabric sections (10A, 10B, 10C) to the main hemming machine (50300) to perform sixth sewing operation on another corresponding portion of the fourth sewing finished first, second and third fabric sections (10A, 10B, 10C).

The second vison system (50400) is configured to capture media (image/picture) of the fourth sewing finished first, second and third fabric sections (10A, 10B, 10C) loaded on main hemming machine (50300) while fifth sewing operation is performed on legs of the fourth sewing finished first, second and third fabric sections (10A, 10B, 10C), and accordingly the second vison system (50400) sends the captured media to the master controller module (70000). For the purpose of this description and case of understanding, the second vision system (50400) includes a second vision sensor (second camera) configured for capturing media (image) of the fourth sewing finished first, second and third fabric sections (10A, 10B, 10C) while performing fifth sewing operation by the main hemming machine (50300).

When the master controller module (70000) determines that the sewing quality on both legs of sewn first, second and third fabric sections (10A, 10B, 10C) is within the acceptable limits/tolerances, the master controller module (70000) is configured to operate the main robotic manipulator (50100) to place the sewn first, second and third fabric sections (10A, 10B, 10C) on a first conveyor (60100) located of sewing system (60000).

Further, the fifth sewing system (50000) may include an auxiliary robotic manipulator (50100B) for grasping and feeding the sewn first, second and third fabric sections (10A, 10B, 10C) from the table or conveyor (50500) to auxiliary hemming machine (50300B) for balancing sixth sewing operation of the main hemming machine (50300). The fifth controller module (50500) is in communication with the master controller module (70000). The fifth controller module (50500) is configured to operate the linear actuators, rotary actuators, hemming machine and conveyors of the fifth sewing system (50000). The robotic manipulators and visions systems of the fifth sewing system (10000) are configured to be operated by the master controller module (70000) and sends the signal to the fifth controller module (50500).

Sixth Sewing System (60000)

The sixth sewing system (60000) is configured to facilitate a sixth sewing operation in which a waistband is attached/seamed to corresponding portion of the fifth sewing finished first, second and third fabric sections (10A, 10B, 10C). For the purpose of this description and case of understanding, the sixth sewing operation is considered to be a waistband sewing operation. It is also within the scope of the invention to consider the sixth sewing operation as any other type of sewing operation in accordance with the fabric type, product type and style of garment to be manufactured by the system (100). In an embodiment, the sixth sewing system (60000) includes a first conveyor (60100), a waistband preparation machine (60200), a waist band attaching machine (60300), a waistband handling apparatus (60400), a first linear actuating system (60500), a first vision system (60600), a main robotic manipulator (60700), a second linear actuating system (60800), a second vision system (60900), a second conveyor (61000) and a sixth controller module (61100).

Once the main robotic manipulator (50100) of the fifth sewing system (50000) places the fifth sewing finished first, second and third fabric sections (10A, 10B, 10C) at an inlet of the first conveyor (60100), the first conveyor (60100) is configured to convey the fifth sewing finished first, second and third fabric sections (10A, 10B, 10C) from an inlet of the first conveyor (60100) to an exit of the first conveyor (60100) such that fifth sewing finished first, second and third fabric sections (10A, 10B, 10C) is positioned in vicinity of the main robotic manipulator (60200).

The waistband preparation machine (60200) is configured to prepare waistbands. The waistband handling apparatus (60400) is mounted onto the first linear actuating system (60500). The waistband handling apparatus (60400) is configured to grasp/grip the waistband from the waistband preparation machine (60200) and load the waistband to the waist band attaching machine (60300). The first linear actuating system (60500) is configured to facilitate movement of the waistband handling apparatus (60400) between the waistband preparation machine (60200) and the waist band attaching machine (60300). The main robotic manipulator (60700) is mounted onto the second linear actuating system (60800). The second linear actuating system (60800) is configured to facilitate a movement of the main robotic manipulator (60700) between the conveyor (60100) and the waistband attaching machine (60300).

Once the waistband is loaded onto the waist band attaching machine (60300), the first vision system (60600) is configured to capture media (image) of the fifth sewing finished first, second and third fabric sections (10A, 10B, 10C) placed on exit of first conveyor (60100), and accordingly the first vison system (60600) sends the captured media to the master controller module (70000). For the purpose of this description and ease of understanding, the first vision system (60600) includes a first vision sensor (first camera) configured for capturing media (image) of the fifth sewing finished first, second and third fabric sections (10A, 10B, 10C) placed on the exit of the first conveyor (60100). Further, the master controller module (70000) is configured to determine co-ordinates of the fifth sewing finished first, second and third fabric sections (10A, 10B, 10C) corresponding to predefined portions of the fifth sewing finished first, second and third fabric sections (10A, 10B, 10C) to be gripped by end effectors/grippers of the main robotic manipulator (60700) and feeding of legs of fifth sewing finished first, second and third fabric sections (10A, 10B, 10C) to the waistband attaching machine (60300) by the main robotic manipulator (60700). Thereafter, the end effectors/grippers of the main robotic manipulator (60700) is configured to grip the predefined portions of the fifth sewing finished first, second and third fabric sections (10A, 10B, 10C) from the first conveyor (60100) and feed the fifth sewing finished first, second and third fabric sections (10A, 10B, 10C) to waistband attaching machine (60300) when the main robotic manipulator (60700) is operated by the master controller module (70000) based on the co-ordinates of the fifth sewing finished first, second and third fabric sections (10A, 10B, 10C) as determined by the master controller module (70000).

Once the fifth sewing finished first, second and third fabric sections (10A, 10B, 10C) is feed to the waistband attaching machine (60300), the waistband attaching machine (60300) is configured to attach the waistband to corresponding portion of the fifth sewing finished first, second and third fabric sections (10A, 10B, 10C) thereby manufacturing the garment (underwear).

The second vison system (60900) is configured to capture media (image/picture) of the waistband attached with the first, second and third fabric sections (10A, 10B, 10C) loaded on waistband attaching machine (60300) during the waistband attaching operation, and accordingly the second vison system (60900) sends the captured media to the master controller module (70000). For the purpose of this description and case of understanding, the second vision system (60900) includes a second vision sensor (second camera) configured for capturing media (image) of the finished garment (10) while performing waistband attaching operation by the waistband attaching machine (60300).

When the master controller module (70000) determines that the waistband attaching quality to the fifth sewing finished first, second and third fabric sections (10A, 10B, 10C) is within the acceptable limits/tolerances, the master controller module (70000) is configured to operate the main robotic manipulator (60700) to grip the finished garment (10) from the waistband attaching machine (60300) and place the finished garment (10) on the second conveyor (61000) for further packaging/storing of the finished garments (10).

Further, the sixth sewing system (60000) may include an auxiliary robotic manipulator (60700B) for grasping and feeding the fifth sewing finished first, second and third fabric sections (10A, 10B, 10C) from the first conveyor (60100) to an auxiliary waistband attaching machine (60300B) for balancing waistband attaching operation of the waistband attaching machine (60300). The sixth sewing system (60000) includes a third linear actuating system (60700C) adapted to mount the auxiliary robotic manipulator (60700B) thereon. The third linear actuating system (60700C) is configured to move the auxiliary robotic manipulator (60700B) between the auxiliary waistband attaching machine (60300B) and the waistband preparation machine (60200). Further, the sixth vision system (60000) includes an auxiliary vision system (60900B) configured to capture media of the waistband attached with the first, second and third fabric sections (10A, 10B, 10C) loaded on waistband attaching machine (60300) during the waistband attaching operation, and accordingly the auxiliary second vison system (60900) sends the captured media to the master controller module (70000). When the master controller module (70000) determines that the waistband attaching quality to the finished garment (10) is within the acceptable limits/tolerances, the master controller module (70000) is configured to operate the auxiliary robotic manipulator (60700) to grip the finished garment (10) from the waistband attaching machine (60300) and place the finished garment (10) on the second conveyor (61000) for further packaging/storing of the finished garment. The sixth controller module (61100) is in communication with the master controller module (70000). The sixth controller module (12700) is configured to operate the linear actuators and rotary actuators of the sixth sewing system (60000). The robotic manipulators and visions systems of the sixth sewing system (60000) are configured to be operated by the master controller module (70000) and sends the signal to the sixth controller module (61100). If master controller module (70000) determines that the sewing quality post sewing of each sewing system (10000-60000) is not within acceptable limits then the sewn fabric sections are rejected. The rejected fabric sections post sewing of each sewing system (10000-60000) are stored and then reworked.

The technical advantages of the system (100) for automated manufacturing of garments are as follows. The system is configured to automatically perform operations on fabric sections to manufacture finished garments without manual intervention and at low costs. The system monitors the operations performed on the fabric sections and automatically adjusts the alignment/handling of the fabric sections to ensure quality finished garments. The system eliminates human error and enhances the sewing quality and increases production of garments.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of embodiments, those skilled in the art will recognize that the embodiments herein can be practiced with modifications within the spirit and scope of the embodiments as described herein.

We claim:

1. A system (100) for automated manufacturing of garments, the system (100) comprising:

a first sewing system (10000) adapted to facilitate automatic handling of first pallets (200) and first fabric sections (10A) for performing a first sewing operation on first fabric sections (10A);

a second sewing system (20000) adapted to facilitate automatic handling of second pallets (300A, 300B) and the first sewing finished first fabric sections (10A) for performing a second sewing operation on corresponding portions of the first fabric sections (10A);

a third sewing system (30000) adapted to facilitate automatic handling of third pallets (400), the second sewing finished first fabric sections (10A) and a second fabric section (10B) for performing a third sewing operation in which the second fabric section (10B) is sewn with the first fabric sections (10A); and a fourth sewing system (40000) adapted to facilitate automatic handling of fourth pallets (500), the third sewing finished first and second fabric sections (10A, 10B) for fourth sewing operation in which third sewing finished first and second fabric sections (10A, 10B) is sewn with corresponding portion of a third fabric section (10C).

2. The system (100) as claimed in claim 1, wherein the first sewing system (10000) includes:

a first pallet storing apparatus (10100) configured to store a plurality of first pallets (200) therein;

a first rotary indexer (10400) in communication with the master controller module (70000);

a first pallet handling system (10200) configured to grasp the first pallet (200) from the first pallet storing apparatus (10100) and load the first pallet (200) onto a first indexing platform of the first rotary indexer (10400);

at least one first fabric handling system (10800) configured to grip first fabric sections (10A) stored or placed on a corresponding first fabric storing zone and load the first fabric sections (10A) onto corresponding face of the first pallet (200);

a second pallet storing apparatus (11100);

a second pallet handling system (11000) is configured to grasp the first pallet (200) along with the first fabric sections (10A) from the first indexing platform of the first rotary indexer (10400) and load the first pallet (200) onto the second pallet storing apparatus (11100);

a sewing machine (11300); and a robotic manipulator (11200) configured to grip the first pallet (200) along with the first fabric sections (10A) and move the first pallet (200) to the sewing machine (11300), wherein the sewing machine (11300) is configured perform first sewing operation on each first fabric sections (10A) while the first pallet (200) is handled or gripped by the robotic manipulator (11200); and the second pallet handling system (11000) is configured to grasp the first pallet (200) from the second pallet storing apparatus (11100) and place the first pallet (200) along with the first fabric sections (10A) loaded thereon to a table which is located in vicinity of the robotic manipular (11200) such that the robotic manipulator (11200) grasps the first pallet from the table.

3. The system (100) as claimed in claim 2, wherein the first sewing system (10000) includes:

a first vision system (10900) configured to capture media of the first pallet (200) with the first fabric sections (10A) that is loaded thereon and send captured media to the master controller module (70000); and a first linear actuating system (10300) adapted to mount the first rotary indexer (10400) thereon, wherein the first linear actuating system (10300) is configured to move the first rotary indexer (10400) and the first pallet handling system (11000), wherein the master controller module (70000) is configured to detect the presence of the first fabric section (10A) and check the alignment (positioning) of the first fabric section (10A) with respect to corresponding face of the first pallet (200) based on the captured media received from the first vision system (10900); and the first fabric handling system (10800) to adjust the corresponding first fabric section (10A) with respect to corresponding face of the first pallet (200) thereby aligning the first fabric sections (10A) with respect to corresponding face of the first pallet (200) when the first fabric handling system (10800) is operated by the master controller module (70000) on determining by the master controller module (70000) that the corresponding first fabric section (10A) is not correctly aligned with respect to corresponding face of the first pallet (200).

4. The system (100) as claimed in claim 3, wherein the first sewing system (10000) includes:

a second vision system (11400) configured to capture media of the first fabric sections (10A) after the first sewing operation on the first fabric sections (10A) and send the captured media to the master controller module (70000), wherein the robotic manipulator (11200) is configured to place the first pallet (200) with the sewn first fabric sections (10A) onto a corresponding table when the robotic manipulator (11200) is operated by the master controller module (70000) upon determining by the master controller module (70000) that the sewing quality of the first fabric sections (10A) is within the acceptable limits;

a conveyor (11600);

a third pallet handling system (11500) configured to grasp the first pallet (10A) from the table and load or place the first pallet (10A) onto the conveyor (11600);

a second rotary indexer (11900);

a fourth pallet handling system (11700) configured to grasp the first pallet (200) from the conveyor (11600) and load or place the first pallet (200) onto a second indexing platform of the second rotary indexer (11900);

at least one second fabric handling system (12300) configured to grip the sewn first fabric sections (10A) from corresponding face of the first pallet (200) and load the first fabric sections (10A) into a corresponding storage bin (12400); and a second linear actuating system (11800) configured to mount the second rotary indexer (11900) thereon, wherein the second linear actuating system (11800) is configured to move the second rotary indexer (11900) between the fourth pallet handling system (11700) and the second fabric handling system (12300), wherein the second rotary indexer (11900) is configured to rotate the first pallet (200) so as to allow unloading of sewn first fabric sections (10A) from remaining faces of the first pallet (200) and placing the sewn first fabric sections (10A) into the storage bins (12400);

the second linear actuating system (11800) is configured to move the second rotary indexer (11900) in a direction towards the fourth pallet handling system (11700) when the second fabric handling system (12300) unloads the first fabric sections (10A) from remaining faces of the first pallet (200); and the fourth pallet handling system (11700) is configured for grasping the empty first pallet (200) from the second indexing platform of the second rotary indexer (11900) and load or place the empty first pallet (200) onto the conveyor (11600).

5. The system (100) as claimed in claim 4, wherein the first sewing system (100) includes:

a fifth pallet handling system (12500) configured to grasp the empty second empty first pallet (200) from the conveyor (11600) and load or place the first pallet (200) onto the first pallet storing apparatus (10100) thereby re-stacking the empty pallets (200) to the first pallet storing apparatus (10100); and a third linear actuating system (12600) configured to move the first pallet storing apparatus (10100) between the fifth pallet handling system (12500) and the first pallet handling system (10200), wherein the conveyor (11600) is configured to move the empty first pallet (200) in a direction towards the fifth pallet handling system (12500).

6. The system (100) as claimed in claim 5, wherein the second sewing system (20000) includes:

a first fabric storing apparatus (20100) is adapted to store a plurality of second pallet bottom member (300A) therein;

a first conveyor (20300) in communication with the master controller module (70000);

a first pallet handling system (20200) configured to grasp the second pallet bottom member (300A) from the first pallet storing apparatus (20100) and load the second pallet bottom member (300A) onto the first conveyor (20300);

a first fabric storing system (20500) having a fabric storage bin adapted to store the first sewing finished first fabric section (10A) received from the first sewing system (10000);

a first fabric handling system (20400) configured to grip the first fabric sections (10A) from the fabric storing bin of the first fabric storing system (20500) and load the first fabric sections (10A) onto corresponding the second pallet bottom member (300A) with respect to corresponding predefined slots provided on the second pallet bottom member (300A);

a second pallet storing apparatus (20600) configured to store a plurality of second pallet top members (300B) therein; and a second pallet handling system (20700) is configured to grasp the second pallet top member (300B) from the second pallet storing apparatus (20600) and load or place the second pallet top member (300B) onto corresponding second pallet bottom member (300A) thereby removably affixing the second pallet top member (300B) with the second pallet bottom member (300A) due to magnetic tapes provided or integrated on the second pallet bottom member (300A) and the second pallet top member (300B), wherein the first conveyor (20300) is configured to move the second pallet bottom member (300A) between the first fabric storing apparatus (20100) and the second pallet handling system (20700).

7. The system (100) as claimed in claim 6, wherein the second sewing system (20000) includes:

a second conveyor (20800) in communication with a master controller module (70000);

a fourth pallet handling system (2100) in communication with the master controller module (70000);

a third pallet handing system (20900) is configured to pick-up or grasp the second pallet bottom and top members (300A, 300B) from the second conveyor (20800) and load/place the second pallet bottom and top members (300A, 300B) onto the fourth pallet handling system (21000); and a sewing machine (21100), wherein the second pallet handling system (20700) is configured to pick-up or grasp the second pallet bottom and top members (300A, 300B) from the exit of the first conveyor (20300) and load/place the second pallet bottom and top members (300A, 300B) onto the second conveyor (20800);

the fourth pallet handling system (2100) is configured to move the second pallet bottom and top members (300A, 300B) along with the first fabric sections in a direction towards the sewing machine (21100); and the sewing machine (21100) is configured to perform a second sewing operation on each first fabric sections (10A) while the second pallet bottom and top members (300A, 300B) is handled or gripped by the fourth pallet handling system (21000).

8. The system (100) as claimed in claim 7, wherein the fourth pallet handling system (21000) moves the second pallet bottom and top member (300A, 300B) away from the sewing machine (21100) such that the third pallet handling system (20900) is configured to grasp the second pallet top member (300B) and separate the second pallet top member (300B) from the second pallet bottom member (300A) placed on the bed (platform) of the fourth pallet handling system (21000);

the third pallet handling system (20900) is configured to move the second pallet top member (300B) away from the fourth pallet handling system (21000) and place the second pallet top member (300B) onto the second conveyor (20800);

the second conveyor (20800) is configured to move the second pallet top member (300B) towards the second pallet storing apparatus (20600);

the second pallet handling system (20700) is configured to pickup/grasp the second pallet top member (300B) from the second conveyor (20800) and load/place the second pallet top member (300B) onto the second pallet storing apparatus (20600) thereby restacking the second pallet top member (300B) onto the second pallet storing apparatus (20600); and the third pallet handling system (20900) is configured to pick up or grasp the second pallet bottom member (300A) from the bed/platform of the fourth pallet handling system (21000) and load/place the second pallet bottom member (300A) onto the second conveyor (20800).

9. The system (100) as claimed in claim 8, wherein the second sewing system (20000) includes:

at least one second fabric storing system (21300) having a fabric storing bin; and a second fabric handling system (21200) is configured to grip corresponding first fabric section (10A) from the second pallet bottom member (300A) and unload/place the second sewing finished first fabric section (10A) into the fabric storing bin of the second fabric storing system (21300), wherein the second conveyor (20800) is configured to move the second pallet bottom member (300A) along with the second sewing finished first fabric sections (10A) to a fabric unloading zone in vicinity of the second fabric handling system (21200);

the second conveyor (20800) is configured to move the empty second pallet bottom member (300A) in a direction towards the exit of the second conveyor (20800) adjacent to the first pallet storing apparatus (20100) when the second sewing finished first fabric sections (10A) are unloaded from the second pallet bottom member (300A); and the first pallet handling system (20200) is configured to grasp the empty second pallet bottom member (300A) from the second conveyor (20800) and places the second pallet bottom member (300A) into the first pallet storing apparatus (20100) thereby restacking the second pallet bottom member (300A) into the first pallet storing apparatus (20100).

10. The system (100) as claimed in claim 9, wherein the third sewing system (30000) includes:

a rotary indexer (30300);

a pallet storing apparatus (30100) adapted to store a plurality of third pallets (400) therein;

a first pallet handling system (30200) configured to grasp the third pallet (400) from the pallet storing apparatus (30100) and load the third pallet (400) onto an indexing platform of the rotary indexer (30300);

a first fabric storing system (30400) adapted to store sewn first fabric section (10A) received from the second sewing system (20000);

a first fabric handling system (30700) configured to grip the first fabric section (10A) from the first fabric storing system (30400) and load the first fabric section (10A) onto the third pallet (400);

a second fabric storing system (30900) configured to store second fabric sections (10B) thereof;

a second fabric handling system (31200) configured to grip and hold both side ends of the second fabric section (10B);

a fabric folding system (31300) configured to fold the side end portions of the second fabric section (10B) and move the side end portions of the second fabric section (10B) to contact corresponding side ends of the first fabric section (10A);

a first vision system (31500) configured for capturing media of the third pallet (400) along with the first and second fabric sections (10A, 10B) loaded thereon and send captured media to the master controller module (70000);

a first robotic manipulator (31800) configured to adjust the second fabric section (10B) with respect to the first fabric section (10A) thereby aligning the side ends of the second fabric section (10B) with respect to corresponding side ends of the first fabric section (10A) when the first robotic manipulator (31800) is operated by the master controller module (70000) based on the reference points (coordinates) of the first fabric section (10A) determined by the master controller module (70000) in accordance to the captured media received from the first vision system (31500);

a second pallet handling system (32000) configured to grasp the third pallet (400) along with the first and second fabric sections (10A, 10B) from the indexing platform of the rotary indexer (30300) and move the third pallet (400) to a second pallet unloading zone;

a sewing machine (32200); and a second robotic manipulator (32100) configured to grasp the third pallet (400) from the second pallet handling system (32000) and move the third pallet (400) to the sewing machine (32200), wherein the sewing machine (32200) is configured perform third sewing operation at the interface (side ends) of the first and second fabric sections (10A, 10B) while the third pallet (400) is handled or gripped by the second robotic manipulator (32100).

11. The system (100) as claimed in claim 10, wherein the third sewing system (30000) includes a second vision system (32300) configured to capture media of the first and second fabric sections (10A, 10B) after the third sewing operation on the first and second fabric sections (10A, 10B) and sends the captured media to the master controller module (70000), wherein the master controller module (70000) is configured to check the sewing quality of the first and second fabric sections (10A, 10B) based on the captured media from the second vision system (32300).

12. The system (100) as claimed in claim 11, wherein the fourth sewing system (40000) includes:

a rotary indexer (40300);

a pallet storing apparatus (40100) adapted to store a plurality of fourth pallets (500) therein;

a first pallet handling system (40200) configured to grasp the fourth pallet (500) from the pallet storing apparatus (40100) and load the fourth pallet (500) onto an indexing platform of the rotary indexer (40300);

a first fabric storing system (40400) configured to store third fabric sections (10C) therein;

a first fabric handling system (40700) configured to grip the third fabric section (10C) from the first fabric storing system (40400) and load the third fabric section (10C) onto the fourth pallet (500);

a first vision system (41100) configured to capture media of the sewn first and second fabric sections (10A, 10B) located on the third pallet (400) that is placed on a table or a conveyor, wherein the first vision system (41100) sends the captured media to the master controller module (70000);

at least one first robotic manipulator (41200) configured to grip predefined portions of the sewn first and second sections (10A, 10B), and place the first and second sections (10A, 10B) onto the fourth pallet (500) with respect to the third section (10C) when the first robotic manipulators (41200) is operated by the master controller module (70000) based on the co-ordinates of the first and second fabric sections (10A, 10B) as determined by the master controller module (70000) in accordance to the captured media received from the first vision system (41100);

a second vision system (41400) configured to capture media of the first, second and third fabric sections (10A, 10B, 10C) loaded on the fourth pallet (500) and sends the captured media to the master controller module (70000);

a second robotic manipulator (41700) configured to adjust the sewn first and second fabric sections (10A, 10B) with respect to the third fabric section (10C) thereby aligning corresponding interfacing portion the first and second fabric sections (10A, 10B) with respect to corresponding interfacing portion of the third fabric section (10C) when the second robotic manipulator (41700) is operated by the master controller module (70000) based on the reference points (coordinates) of the third fabric section (10C) as determined by the master controller module (70000) in accordance to the captured media received from the second vision system (41400);

a second pallet handling system (41900) configured to grasp the fourth pallet (500) along with the first, second and third fabric sections (10A, 10B, 10C) from the indexing platform of the rotary indexer (40300) and move the fourth pallet (500) to a second pallet unloading zone;

a sewing machine (42100) in communication with the master controller module (70000); and a third robotic manipulator (42000) configured to grasp the fourth pallet (500) from the second pallet handling system (41900) and move the fourth pallet (500) to the sewing machine (42100), wherein the sewing machine (42100) is configured to perform a fourth sewing operation at the interface of the first and second fabric sections (10A, 10B), and the third fabric section (10C) while the fourth pallet (500) is handled or gripped by the third robotic manipulator (42000); and a third vision system (42200) configured to capture the media of the first, second and third fabric sections (10A, 10B, 10C) along with the sewing made thereon and send the captured media to the master controller module (70000), wherein the second robotic manipulator (32100) of the third sewing system (30000) is configured to place the third pallet (400) on the table or conveyor adjacent to first robotic manipulator (41200) of the fourth sewing system (40000), wherein the table or conveyor includes a pallet clamp unlocking system configured to unlock clamps of the third pallet (400) prior to the first robotic manipulator (41200) grip the first and second fabric sections (10A, 10B) from the third pallet (400).

13. The system (100) as claimed in claim 12, wherein the system (100) includes a fifth sewing system (50000) adapted to facilitate automatic handling of fourth sewing finished first, second and third fabric sections (10A, 10B, 10C) for performing hemming operation on both legs of the fourth sewing finished first, second and third fabric sections (10A, 10B, 10C), wherein the fifth sewing system (50000) includes:

a main robotic manipulator (50100) in communication with the master controller module (70000);

a conveyor (50500) adapted to move the fourth sewing finished first, second and third fabric sections (10A, 10B, 10C) towards the main robotic manipulator (50100);

a first vision system (50200) configured to capture media (s) of the fourth sewing finished first, second and third fabric sections (10A, 10B, 10C) placed the conveyor (50500), and accordingly the first vison system (50200) sends the captured media to the master controller module (70000); and a main hemming machine (50300), wherein the master controller module (70000) is configured to determine co-ordinates of the fourth sewing finished first, second and third fabric sections (10A, 10B, 10C) based on the media received from the first vision system (50200);

the main robotic manipulator (50100) is configured to grip predefined portions of the fourth sewing finished first, second and third fabric sections (10A, 10B, 10C) and feed each leg of fourth sewing finished first, second and third fabric sections (10A, 10B, 10C) to the main hemming machine (50300) when the main robotic manipulator (50100) is operated by the master controller module (70000) based on the co-ordinates of the fourth sewing first, second and third fabric sections (10A, 10B, 10C) as determined by the master controller module (70000); and the main hemming machine (50300) is configured to perform hemming operation on each leg of the fourth sewing finished first, second and third fabric sections (10A, 10B, 10C), wherein the third robotic manipulator (42000) of the fourth sewing system (40000) is configured to place the fourth sewing finished first, second and third fabric sections (10A, 10B, 10C) on the conveyor (50500) of the fifth sewing system (50000) when the master controller module (70000) determines that sewing quality of the first and second fabric sections (10A, 10B) with the third fabric section (10C) is within the acceptable limits.

14. The system (100) as claimed in claim 13, wherein the fifth sewing system (50000) includes:

a second vision system (50400) configured to capture media of the fourth sewing first, second and third fabric sections (10A, 10B, 10C) loaded on main hemming machine (50300) while hemming operation is performed on corresponding portions of the fourth sewing finished first, second and third fabric sections (10A, 10B, 10C), and accordingly the second vison system (50400) sends the captured media to the master controller module (70000), wherein the fifth sewing system (50000) includes an auxiliary robotic manipulator (50100B) for grasping and feeding the fourth sewing finished first, second and third fabric sections (10A, 10B, 10C) from the conveyor (50500) to an auxiliary hemming machine (50300B) for balancing hemming operation of the main hemming machine (50300).

15. The system (100) as claimed in claim 14, wherein the system (100) includes a sixth sewing system (6000) adapted to facilitate automatic handling of waistband, and fifth sewing finished first, second and third fabric sections (10A, 10B, 10C) for attaching the waistband to corresponding portion of the fifth sewing finished first, second and third fabric sections (10A, 10B, 10C), wherein the sixth sewing system (6000) includes:

a waistband preparation machine (60200) configured to prepare waistbands;

a waist band attaching machine (60300);

a waistband handling apparatus (60400) configured to grasp the waistband from the waistband preparation machine (60200) and load the waistband to the waist band attaching machine (60300);

a first linear actuating system (60500) adapted to mount the waistband handling apparatus (60400) thereon, wherein the first linear actuating system (60500) is configured to move the waistband handling apparatus (60400) between the waistband preparation machine (60200) and the waist band attaching machine (60300);

a main robotic manipulator (60700) in communication with the master controller module (70000);

a first conveyor (60100), wherein the main robotic manipulator (50100) of the fifth sewing system (50000) is configured to place the fifth sewing finished first, second and third fabric sections (10A, 10B, 10C) on the first conveyor (60100) when the main robotic manipulator (50100) is operated by the master controller module (70000) on determining, by the master controller module (70000) that the hemming quality on both legs of fourth sewing finished first, second and third fabric sections (10A, 10B, 10C) is within the acceptable limits, wherein the first conveyor (60100) is configured to move the fifth sewing finished first, second and third fabric sections (10A, 10B, 10C) towards the main robotic manipulator (60700); and a first vision system (60600) is configured to capture media of the fifth sewing finished first, second and third fabric sections (10A, 10B, 10C) and accordingly the first vison system (60600) sends the captured media to the master controller module (70000).

16. The system (100) as claimed in claim 15, wherein the master controller module (70000) is configured to determine co-ordinates of the fifth sewing finished first, second and third fabric sections (10A, 10B, 10C) corresponding to predefined portions of the fifth sewing finished first, second and third fabric sections (10A, 10B, 10C) placed on the first conveyor (60100); and the main robotic manipulator (60700) is configured to grip the predefined portions of the fifth sewing finished first, second and third fabric sections (10A, 10B, 10C) from the first conveyor (60100) and feed the fifth sewing finished first, second and third fabric sections (10A, 10B, 10C) to waistband attaching machine (60300) when the main robotic manipulator (60700) is operated by the master controller module (70000) based on the co-ordinates of the fifth sewing finished first, second and third fabric sections (10A, 10B, 10C) as determined by the master controller module (70000), wherein the sixth sewing system (60000) includes a second linear actuating system (60800) adapted to mount the main robotic manipulator (60700) thereon, wherein the second linear actuating system (60800) is configured to facilitate a movement of the main robotic manipulator (60700) between the conveyor (60100) and the waistband attaching machine (60300); and the waistband attaching machine (60300) is configured to attach the waistband to corresponding portion of the fifth sewing finished first, second and third fabric sections (10A, 10B, 10C).

17. The system (100) as claimed in claim 16, wherein the sixth sewing system (60000) includes:

a second vison system (60900) configured to capture media of the waistband attached with the first, second and third fabric sections (10A, 10B, 10C) loaded on waistband attaching machine (60300) during the waistband attaching operation, and accordingly the second vison system (60900) sends the captured media to the master controller module (70000); and a second conveyor (61000), wherein the main robotic manipulator (60700) to grip the finished garment (10) from the waistband attaching machine (60300) and place the finished garment on the second conveyor (61000) when main robotic manipulator (60700) is operated by the master controller module (70000) on determining by the master controller module (70000) that the waistband attaching quality with respect to the first, second and third fabric sections (10A, 10B, 10C) is within the acceptable limits.

18. The system (100) as claimed in claim 17, wherein the sixth sewing system (60000) includes:

an auxiliary robotic manipulator (60700B) configured or grasping and feeding the fifth sewing finished first, second and third fabric sections (10A, 10B, 10C) from the first conveyor (60100) to another waistband attaching machine (60300B) for balancing waistband attaching operation of the waistband attaching machine (60300);

a third linear actuating system (60700C) adapted to mount the auxiliary robotic manipulator (60700B) thereon, wherein the third linear actuating system (60700C) is configured to move the auxiliary robotic manipulator (60700B) between the auxiliary waistband attaching machine (60300B) and the waistband preparation machine (60200); and an auxiliary vision system (60900B) configured to capture media of the waistband attached with the first, second and third fabric sections (10A, 10B, 10C) loaded on waistband attaching machine (60300) during the waistband attaching operation, and accordingly the auxiliary second vison system (60900) sends the captured media to the master controller module (70000), wherein the auxiliary robotic manipulator (60700) to grip the finished garment from the waistband attaching machine (60300) and place the finished garment on the second conveyor (61000) when the auxiliary robotic manipulator (60700) is operated by the master controller module (70000) on determining by the master controller module (70000) that the waistband attaching quality with respect to first, second and third fabric sections (10A, 10B, 10C) is within the acceptable limits.

* * * * *